US006449914B1

(12) United States Patent
Horstketter et al.

(10) Patent No.: US 6,449,914 B1
(45) **Date of Patent: *Sep. 17, 2002**

(54) GROUT SEALING APPARATUS FOR CONCRETE PANELS, DECKS, AND SUPPORT BEAMS AND METHODS FOR THEIR FABRICATION

(75) Inventors: Eugene A. Horstketter, 400 Regentview, Houston, TX (US) 77079; Ken Bernard, Houston, TX (US); Nat Smith, Houston, TX (US)

(73) Assignee: Eugene A. Horstketter, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/658,722

(22) Filed: Sep. 11, 2000

Related U.S. Application Data

(63) Continuation-in-part of application No. 09/053,996, filed on Apr. 2, 1998, now Pat. No. 6,115,979.

(51) Int. Cl.[7] ..... E04B 1/62

(52) U.S. Cl. ..... 52/393; 52/251; 52/252; 52/259; 52/434; 52/402; 52/459; 52/321; 52/322; 52/332; 52/335

(58) Field of Search ..... 52/393, 251, 252, 52/259, 434, 402, 459, 321, 322, 332, 335, 742.16

(56) References Cited

U.S. PATENT DOCUMENTS 6,115,979 A * 9/2000 Horstketter et al. ..... 52/393

* cited by examiner

*Primary Examiner*—Beth A. Stephan
*Assistant Examiner*—Patrick J. Chavez
(74) *Attorney, Agent, or Firm*—Kenneth A. Roddy

(57) ABSTRACT

Resilient and flexible grout seal strips for sealing off a space formed between the bottom of a concrete panel and a support beam on which the panels are supported, concrete panels, decks, and support beams having resilient and flexible grout seals and methods for fabricating such panels, beams and decks are disclosed. The grout seal strips have a first longitudinal edge adapted to be anchored on either the bottom of a precast panel or the top of a support beam adjacent the respective side edge thereof and extend substantially the length thereof, and have an opposed second longitudinal edge with a wide sealing portion therebetween adapted to engage the other of the panel bottom or the beam top adjacent the respective side edge thereof and form a sealing relation therewith. The seal strips become deflected when the panel side edge is set down upon the beam and when vertically adjusted relative thereto and thereby maintain a sealing relation to resist horizontal pressure of the concrete or grout introduced into the space and prevent leakage thereof past the engaged seal strip. A two-part grout seal strip has an anchor channel that is embedded in the concrete member and a resilient seal part having a protrusion engaged in the anchor channel. The panels may also be provided with jack screws having a protective foot to prevent tearing the seal strip.

29 Claims, 22 Drawing Sheets

GROUT SEALING APPARATUS FOR CONCRETE PANELS, DECKS, AND SUPPORT BEAMS AND METHODS FOR THEIR FABRICATION

CROSS REFERENCE TO RELATED APPLICATION

This is a continuation-in-part of U.S. application Ser. No. 09/053,996, Apr. 2, 1998, now U.S. Pat. No. 6,115,979, and priority thereof is claimed.

BACKGROUND OF THE INVENTION

1. Field of the Invention

This invention relates generally to concrete panels for use in making concrete decks or floors for spanning between structural supports; and more particularly to resilient grout seals for precast concrete panels and beams used in constructing reinforced concrete decks for bridges supported by structural beams, and methods for fabricating concrete panels, decks, and support beams having grout seals.

2. Brief Description of the Prior Art

The construction of reinforced concrete decks and floors (e.g. on bridges and in buildings) has always been the most labor intensive and most costly component of the superstructure involved, and has been the component that controls the overall rate of progress of the construction. The need for temporary support of the reinforcing steel and freshly poured concrete until the concrete has attained sufficient strength to support itself is a major factor in the cost of such construction. The length of time such support must remain in place to allow the concrete to attain sufficient strength is the major factor in controlling the rate of progress of the structure.

The original method to provide the temporary support was to use a basic wood form made up of boards or plywood sheeting nailed to wood joist members, carried on wood timbers or steel beams, which in turn were supported on posts or columns from the ground or lower completed floor. This method is still used today with the development of a variety of complex high capacity column scaffolding systems and beam members that are adjustable for both span length and camber. Other developments in the use of the basic wood form include hanger systems that provide for hanging the form from the beam members of the permanent structure, thereby eliminating the need of posts or columns from below. Another development involved trussed framing systems that provided for the support of large areas of form on a very few bearing supports, and for the removal and re-setting of such large areas as a single unit.

The cost of using basic wood forms would be prohibitive if they were used just once, but they are normally not consumed or destroyed in a single use and are in fact in normal practice re-used several times before wear and tear makes them unfit for further re-use. The greater the number of re-uses of the forms, the more economical they become. Economics therefore dictates that the effort on any given project is to provide the minimum quantity of form that will permit reasonable progress to be achieved on the project, thereby gaining the greatest number of re-uses, even though availability of a greater quantity of forms would provide for a faster rate of progress.

The setting of wood forms preparatory to the placement of reinforcing steel and concrete is a labor intensive task by itself, but removing wood forms after the concrete has attained sufficient strength, usually requiring extensive scaffolding, requires a greater amount of costly labor and equipment. Moving to the location of its next use and the clean up and preparation for re-use of the form adds more labor and equipment cost.

The high labor and equipment costs, and the limitation of progress inherent in the use of wood forms, has encouraged development of alternative methods of providing support for deck and floor construction. The development of methods using materials that are durable, yet economical enough to be used once and then left in place, are gaining in favor. Some methods provide temporary support only and after the concrete has gained its strength are simply left in place. Light gage galvanized corrugated sheet steel panels supported directly by the permanent structure beams id the most popular of these methods.

Some methods provide temporary support but in addition become an integral permanent working part of the structure when the concrete gains its strength. Heavy gage corrugated sheet steel panels, supported directly by the permanent structure beams, with loop shear connectors connected (e.g. by welding) to the panels and then embedded in the concrete to make the panels and the cured concrete work as a composite unit is one example of this method. The most recent development in this area is the precast pre-stressed concrete panel supported directly by the permanent structure beams, and again the panels and the cast-in-place concrete work as a composite unit. The panels replace the wood forms and serve both as a form and as an integral part of the structure. A desired amount of concrete is poured onto the already-formed and already-hardened panel.

In becoming a permanent composite component of the structure, the panels replace structural materials that would otherwise have to be provided in the design of the structure. In the case of the sheet steel panels, part of the reinforcing steel is replaced by the panel. In the case of the pre-stressed panel, a substantial part of the reinforcing steel and of the concrete is replaced by the panel.

In exposed structures such as bridges, the concrete panels are popular with engineers and architects because they blend in with the appearance of the structure and provide the most natural look. Another important reason is that they are not subject to corrosion that might diminish the appearance at some later date, or even become a hazard by falling from the structure as sheet steel might do.

The currently popular design of pre-stressed concrete panels leaves serious and costly problems in the construction technique. To accomplish the composite relationship between the panel and the cast-in-place concrete, the first requirement is that the panel have a continuous rigid bearing contact with the top of the supporting beam along its ends. Since neither the top of the beam or the bottom of the panel can be depended upon to be perfectly flat, an intervening material, normally concrete or cement grout, that can be installed in a plastic state so it will conform to both surfaces and then harden in that shape is required. General practice (see FIG. 1) is to place a narrow strip of fiberboard along the edges of the top flange of the supporting beam, to set the concrete panel thereon so the panel overhangs the fiberboard strip over the beam, and then to either force the intervening material in its plastic state under the overhanging part of the panel, or wait until the cast-in-place concrete is poured and at that time force the concrete mix being used to flow under the overhanging part of the panel. The fiberboard is of sufficient thickness to allow for the intervening material to be forced under the overhanging part of the panel, and it prevents the plastic material from flowing over the edge of the beam.

To provide for the deflection of the beams and the design cambers that are required to provide the desired finished grade, the designer and/or the constructor is left with three undesirable options in the use of this method. The thickness of the fiberboard material (or other filler or sealing material) can be varied to compensate for deflection and camber which allows the thickness of the slab to remain constant; the thickness of the slab can be varied to provide the desired top surface grade while the bottom surface follows the deflection and camber of the beam; or the top surface of the beam can be re-graded to provide for deflection and camber with a cast-in-place concrete overlay prior to the placement of the fiberboard strips.

If the thickness of the fiberboard strip is varied, (see FIG. 1) measurement and placement of the strips according to a pre-calculated layout must be done by workmen working on top of the bare beams before the panels can be placed. This is slow and dangerous work, and completed work can easily be knocked or blown off of the beam, and at best the amount of variation that can be accomplished is very limited because excessive thickness of the fiberboard becomes unstable.

Methods of using concrete bricks under the panels along with galvanized sheet steel angles (see FIG. 3) to close the opening between the panel and the top of the beam between bricks are available, but extremely labor intensive and time consuming. There is no way to adjust panels after they are in place, so if errors are discovered at this time, the only way to make corrections is to remove the panels and start over.

If the thickness of the slab is varied, all the variation must be in added thickness, since design requirements are a minimum thickness. The cost of the excess concrete is a complete loss and again the amount of variation that can be accomplished is very limited because too much excess concrete would add too much dead load to the slab and to the structure.

Re-grading the top surface of the beam (see FIG. 2) provides satisfactory results, but is clearly the most costly and time consuming of all of the options.

The most recent method to provide the variable space between the bottom of the panel and the top of the beam and to prevent the plastic material from flowing over the edge of the beam is the use of threaded bolts inserted through threaded inserts embedded in the panels when cast, to support the panel, and a plastic seal strip, also embedded in the panel when cast, and installed on the structural beams with the use of a special erection tool, to prevent the plastic material from flowing over the edge of the beam (see FIG. 4). In this method typically four threaded inserts are embedded in each panel, two along each end of the panel that will overhang the structural beam when the panel is erected in place and near the quarter points along the length of the panel. A plastic seal strip is positioned horizontally on the bottom of the panel with one edge embedded in the panel the full length of each end of the panel that will overhang the structural beam. The embedded edge is positioned to fall over the edge of the structural beam when erected and the other edge extends a short distance beyond the end of the panel. Either in the casting yard, or when the panels are delivered to the structure on which they are to be used, threaded jack bolts are inserted through the four embedded threaded inserts to extend a desired distance below the bottom of the panel. The jack bolts move the seal strip as they protrude from the bottom of the panel, and a special seal depressor erection tong (see FIG. 8) moves the strip to rotate about the embedded edge past the vertical to a position for them to pass down between the two supporting beams as the panel is lowered into position on the bridge. The erection tong provides attachment to the panel for it to be lifted and set in place on the support beams. When the panel is set in place it bears on the threaded jack bolts and the seal depressor erection tong is released allowing the seal strips to spring back to contact the top edges of the beams to accomplish the grout seal. The panel can then be graded by use of the jack bolts while the seal strip maintains its seal by sliding up or down on the edge of the beams.

This method provides for a constant thickness slab with a wide range of adjustability for camber and deflection but still leaves serious and costly problems. The successful use of the plastic in the seal strip depends on the distribution of unit bending over a wide band of the strip to avoid stress concentration, however the prior art is subject to grout intrusion that forces localized bending and thereby stress concentration. In the application where the seal strip is left in its erected and therefore stressed state for an extended period of time, stress relaxation and deformation reduce the pressure against the side of the support beam and its ability to effectively seal the grout. The seal depressor erection tong is an expensive extra piece of equipment. Due to rotation of the tines around the ends of the panels, interference with reinforcing steel protruding from the top of concrete support beams, or shear studs welded to the top of steel support beams is frequently encountered and costly adjustments in the reinforcing steel or studs is necessary.

Bridge designers are constantly increasing the length of bridge spans and thereby increasing camber and deflection so the wide range of adjustability of this method is sometimes still not enough. Two methods to increase the range of adjustability of the present method are to make the seal strip wider, and make it out of a stiffer premium material capable of withstanding the degree of bending and rebound required, or making the seal strip thicker to make it stiffer, which would also require a premium material due to the substantially higher stresses developed in the thicker material bending to the required radius. The premium material is inherently expensive and the extra width required for the increased haunch height adjustability would have to protrude out from under the edge of the panel in the casting bed, where it would be an obstacle to the bulkhead form. The protruding seal strip would also be subject to damage during storage and handling of the panel and require excessive blocking or dunnage between panels to allow for the swing of the strip when deflected for erection by the erection tool.

There is also a problem with the threaded jack bolt in that, when they are inserted through the embedded threaded insert and they deflect the seal strip, the sharp bottom edge of the bolt sometimes cuts into and tears the seal strip. If the bolt bottom edge is chambered or filleted, the reduced bearing area of the bolt on the structural support beam can become insufficient and scouring and deformation can occur.

Thus, there is a need for efficient and economical apparatus and method for making a concrete deck to span structural supports that is quick to set, and free of problems due to casting yard grout intrusion, and capable of remaining effective for extended periods between panel erection and pouring of cast-in-place concrete. There also is a need for efficient and economical apparatus and method for making a concrete deck to span structural supports that is quick to set, and that is easy to grade on the ever increasing span lengths, with their ever increasing span lengths, of current and future bridges. There is further a need for an efficient and economical apparatus and method for making a concrete deck to span structural supports that is quick to set without special tools or equipment, or interference with beam reinforcing steel or studs when the bridge design requires it. There also is a need for an attachable foot for the threaded jack bolt that will both reinforce the bearing of the bolt on the structural beam and prevent the bolt from cutting and tearing the seal strip during erection.

There are several patents which disclose various apparatus and methods for constructing concrete beams, panels and decks.

My previous patents, Horstketter, U.S. Pat. Nos. 4,982,538 and 5,218,795 disclose concrete panels, concrete decks, parts thereof, and apparatus and methods for their fabrication and use.

O'Keefe et al, U.S. Pat. No. 4,761,927 discloses a pair of finger gaskets that extend between opposed laterally spaced sides of a pair of C-shaped rafters in overlapped relation and which slide over each other.

None of these references taken alone or in any combination teaches or suggests a flexible resilient grout seal strip with a support beam/precast concrete panel connection in accordance with the present invention.

SUMMARY OF THE INVENTION

The present invention is directed to apparatus and methods which solve the problems of the prior art and provide the means to set precast reinforced, or precast pre-stressed concrete panels that span between beams directly on the supporting structural beams with no prior preparation; to adjust the grade of the panels to provide for deflection and camber over a wider range of adjustment than provided by the prior art, before or after setting, with little or no loss of material. The present apparatus and methods do not require the use of a special seal depressor tool in situations where interference with reinforcing steel protruding from the top of concrete support beams, or shear studs welded to the top of steel support beams, would otherwise occur with the use of such tool. Another aspect of the present invention overcomes the problems of the prior art and provides the means to avoid tearing the seal strip when inserting threaded jack bolts and to reinforce the bearing of the jack bolts.

In the precast deck panels of this invention, threaded jack bolts may be used to provide adjustability of each panel. The seal that contains the grout or concrete that is forced between the bottom of the panel and the top of the supporting beam for bearing slides on the edge of the beam, or on the bottom surface of the panel, and is capable of maintaining its sealing action over a wide range of adjustment of the space between the two. At any stage prior to pouring concrete on a panel, the bolt can be adjusted upwardly (or downwardly) and the grout seal will extend sufficiently that the seal between the beam and the panel will be maintained. The grout seal also acts as a concrete form and is capable of resisting the horizontal pressure of the plastic grout or concrete poured against it and thereby prevents it from simply flowing over the edge of the beam.

The present grout seal strip deflects to the position to pass down between the support beams for erection with less unit bending and stress than the prior art. The reduced unit bending and stress during the erection procedure provides an increased rebound pressure against the side of the support beam and an increased resistance to the horizontal pressure of the plastic grout or concrete poured against it. In the prior art, an open inverted "V" at the anchor is intended to provide room for the seal strip to deflect so the deflection will start at the anchor edge of the strip and attain unit deflection over a wide band of the strip, thus minimizing the unit deflection and stress at any point during the deflection required by the erection procedure. However, during the casting of the panel, grout from the panel seeps into and fills the space provided, forcing the seal strip to concentrate deflection over the hardened grout and developing high concentrated stress at that point. The present invention solves this problem by providing a wide convex cavity with a long radius bend forming one side and a relatively flat sloping opposite side at the anchor so that any grout that seeps into it and hardens will be easily expelled by the deflection of the strip. The long radius bend is thickest at the anchor, and tapers down over a wide portion of the strip to improve the distribution of unit deflection and further minimize unit stress at any point.

For situations where the panels are in place for an extended period of time between their erection and the pouring of the cast-in-place concrete, such as erection of the panel during the winter and the pouring of the cast-in-place concrete in the spring, the present invention provides a seal strip having a wide flat portion with an inverted anchor channel portion along one longitudinal side that embeds into the bottom of the panel and has a vertical angularly sloped leg portion integrally hinged to a horizontal top portion. When the seal strip is deflected by the erection tong, its flat portion and sloped leg portion rotate as a unit about the hinge with little bending and stress. At a predetermined point in the rotation of the seal strip, its wide flat portion will contact the opposite generally vertical leg of the channel at the bottom of the panel, and/or the rotated sloped leg will bear against the top of the inverted channel, and then bend the remaining wide flat portion. To keep grout from filling the channel during the casting of the panel, it is filled with a plastic foam or like material. If a closed cell foam material is used, the air trapped within the closed cells will compress and react about the hinge to provide added load to force the seal strip against the side of the supporting beam and the compressed air will act as a spring that will compensate for any stress relaxation and deformation in the plastic.

For bridges designed with extreme haunch heights, the present invention provides a two-part seal made up of an anchor channel embedded in the panel and a seal strip that is inserted into the anchor channel. The anchor channel is positioned on a line that will fall approximately over the edge of the supporting beam when the panel is erected and in the erection procedure, the seal strip will bear against the side of the top flange of the supporting beam for the full length of the panel.

The grout seal strips and anchor channels can embedded in the bottom of the concrete panels during the casting of the panels, and after the panel is cured and removed from the forms the embedded anchor can either be left in place, or removed to form an anchor channel in the concrete, to receive and secure the seal strip portion.

Due to the necessary increase in the stiffness of the seal strip with increased space between the bottom of the panel and the top of the supporting beams, the panel adjustability of the prior art is limited. As the space increases, so does the length of seal subject to the horizontal pressure of the grout or concrete poured against it, and because the seal acts as a cantilever beam, the stress in the seal is compounded by greater load and increased span. The adjustability of the prior art panels is limited by the capacity of a thicker or stiffer plastic material to deflect from the horizontal as-cast position through the 135 degree bend to the position preparatory to passing down between support beams in the erection procedure, and still rebound to apply sufficient pressure against the side of the top flange of the support beam to resist the horizontal pressure of the plastic grout or concrete poured against it and provide an adequate seal. The panel adjustability of the prior art is also limited by the practical limit of the width of the seal strip that can be accommodated by the bulkhead form in the casting bed.

The seal strip of the present invention can be made in a variety of widths and stiffness to provide for greater panel adjustment because by being inserted into the embedded or formed anchor channel after the panel is removed from the form, it can be shaped to require less deflection, or no deflection at all to the position preparatory to passing down between support beams in the erection procedure. The lower erection stress provides greater rebound at any space between the panel and the support beam and thereby a better seal against leakage of grout.

For bridges designed with reinforcing steel protruding from the top of concrete beams, or shear studs welded to the top of steel beams, that would interfere with the operation of the erection tong, the present invention provides a grout seal strip having an anchor portion of which can be embedded into the top of the beam in the casting bed, rather than the panel, or secured to the top edge of the beam at any time prior to the setting of the precast panel. The grout seal strip can be positioned to stand near vertical along the edges of the top flange of the beam for the full length of the beam with the top edge of the strip curved or bent to the outside so it will deflect to the outside under the weight of the panel being lowered down on it. When used with structural steel beams, the strip may be bonded to the top edge or side of the top flange, or may be molded with a pair of horizontal extensions that fit under and over the flange plate in a tight fit, or be secured with straps from the strip on one edge across the beam to the strip on the opposite edge at spaced intervals along the beam.

When conventional jack bolts of the prior art are inserted through the embedded threaded inserts, they first encounter and deflect the seal strip. Due to the sharp square edge of the bottom of the bolt, puncture and tearing of the seal strip can occur. When the jack bolt is used in a maximum size panel, and is set to bear on a rough surface support beam, the bottom end of the bolt can be abraded away as the bolt is turned to raise the panel. The present invention solves those problems by providing a foot that is easily attachable to the bottom of the jack bolt.

It is, therefor, an object of the present invention to provide a novel, efficient, and economical apparatus and method for forming concrete decks or floors between structural supports.

Another object of the present invention is the provision of a precast concrete panel which can span between structural supports and can rest directly on the supports.

Another object of present invention is the provision of such panels with means for adjusting the grade of the panels to provide for deflection and camber before or after setting with little loss of material.

Another object of the present invention is the provision of a grout seal for such panels that ejects any grout that may seep into and harden in the anchor void.

Another object of the present invention is the provision of a grout seal for such panels that employs compressed air to provide spring sealing pressure, and compensates for plastic stress relaxation and deformation.

Another object of the present invention is the provision of a grout seal for such panels that requires no special tools or equipment to erect the panels.

Another object of the present invention is the provision of a grout seal that requires no panel end clearance for an erection tool.

Another object of the present invention is the provision of a grout seal strip with a separate anchor for embodiment in a precast concrete panel.

Yet another object of the present invention is the provision of a grout seal strip with means for attachment to the bottom of a precast concrete panel after fabrication of the panel.

A further object of this invention is the provision of a foot to be used in conjunction with the jack bolt of the prior art that will prevent the bolt from punching and tearing the seal strip.

A still further object of this invention is the provision of a foot to be used in conjunction with the jack bolt of the prior art that will protect the bolt against abrasion.

To those of skill in this art who have the benefit of this inventor's teachings, other and further features, objects, and advantages will be clear from the following description of the preferred embodiments where taken in conjunction with the drawings, and of which are given for the purpose of disclosure.

DESCRIPTION OF THE PREFERRED EMBODIMENTS

Figure 1:
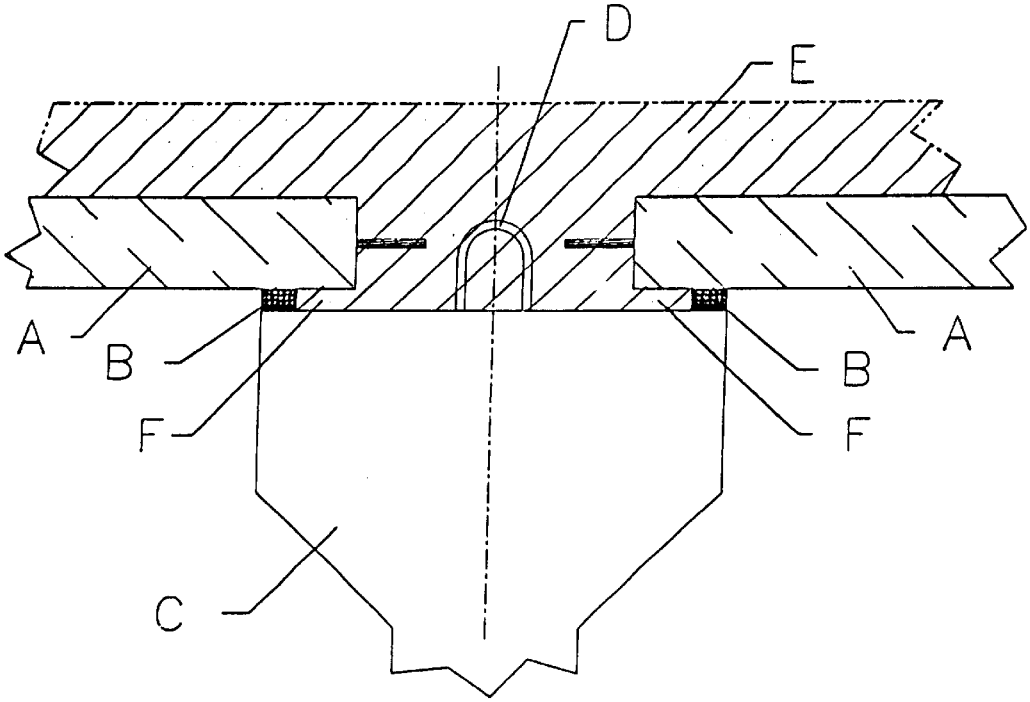
Fig. 1 (Prior Art)
FIGS. 1–6 are side cross-sectional views of prior art support beams, panels and decks.

Referring now to the drawings by numerals of reference, there is shown in FIG. 1, a typical prior art deck forming apparatus and method. Concrete panels A are emplaced on fiberboard inserts B on a support beam C. A metal loop D embedded in the beam C extends up into the poured concrete deck E. Poured concrete has filled the gaps F between the ends of the panels A and the top surface of the beam C.

Figure 2:
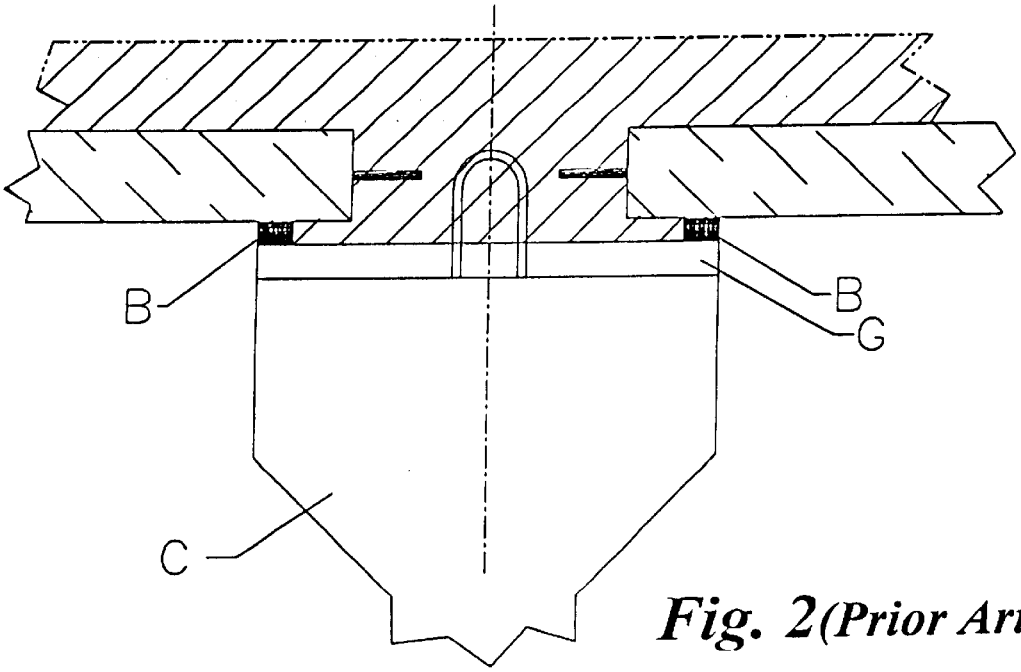
Fig. 2 (Prior Art)
Figure 3:
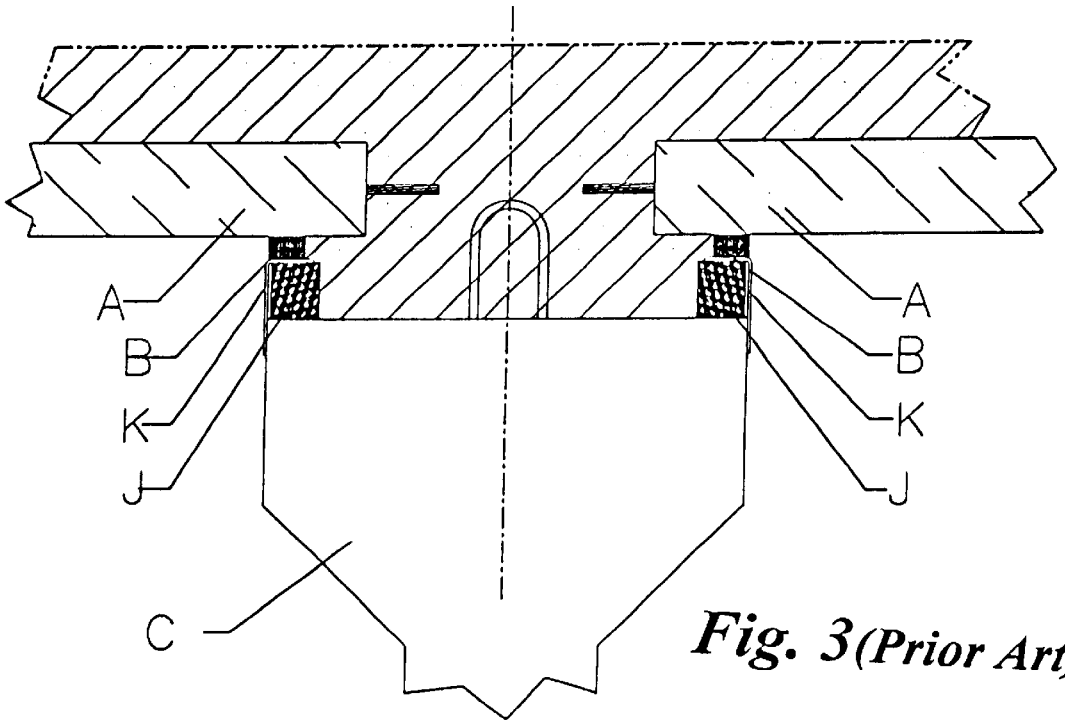
Fig. 3(Prior Art)
Figure 4:
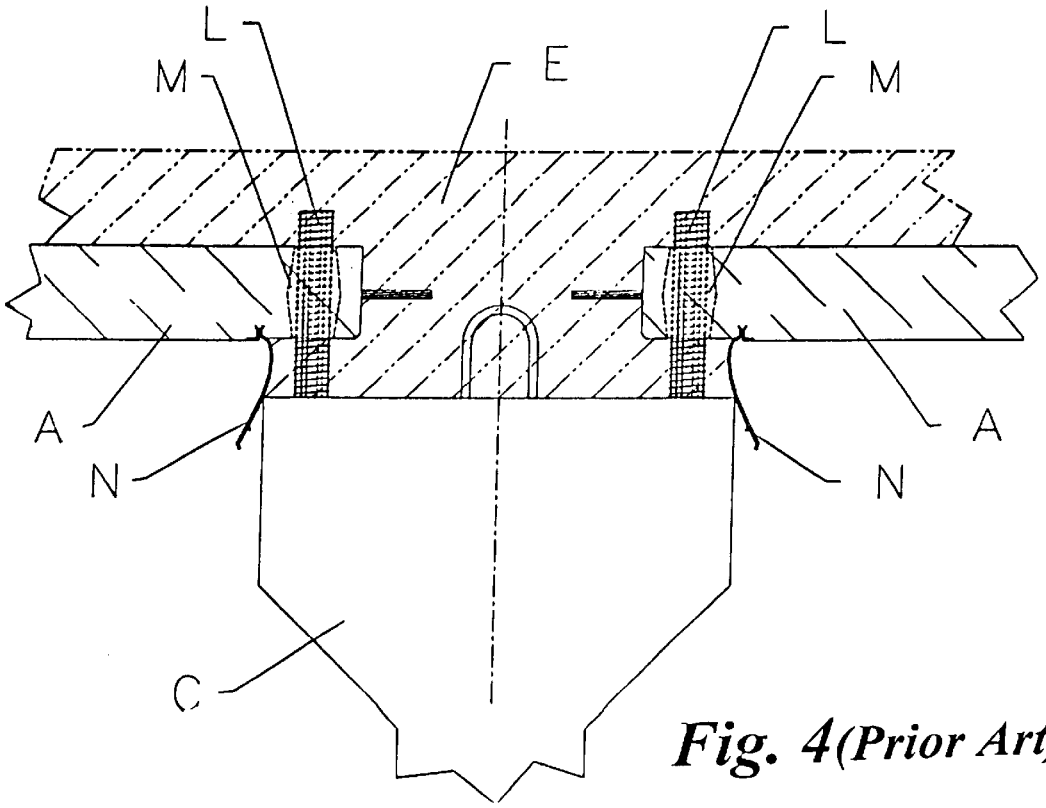
Fig. 4(Prior Art)

FIGS. 2, 3 and 4 illustrate additional typical prior art deck forming apparatus and methods for use where the distance between the top of the support beam C and the finished grade cannot be achieved within desirable tolerances with cast-in-place slab thickness and fiberboard. In FIG. 2 additional height is provided by using a cast-in-place concrete overlay G to re-grade the top surface of the beam C. In FIG. 3 additional height is provided by emplacing concrete blocks J along the edges of the panels A. Sheet metal angles K are used between the blocks J for sealing the space between the panels A and the top of the beam C to prevent the grout or concrete from flowing over the edge of the beam between the concrete blocks J. Fiberboard B is used between the angles K and the panels A. In FIG. 4 adjustable additional height is provided by the use of at least two threaded inserts M embedded in each end of each panel A in the area that overhangs the beam C and a threaded jack bolt L inserted therethrough. A seal strip N with one edge embedded in the bottom of the panels A is installed with a special erection tool to bear against the side top edge of the beam C and provides a sliding seal to prevent the grout or concrete from flowing over the edge of the beam between the bottom of the panels A and the top of the beam.

Figure 5:
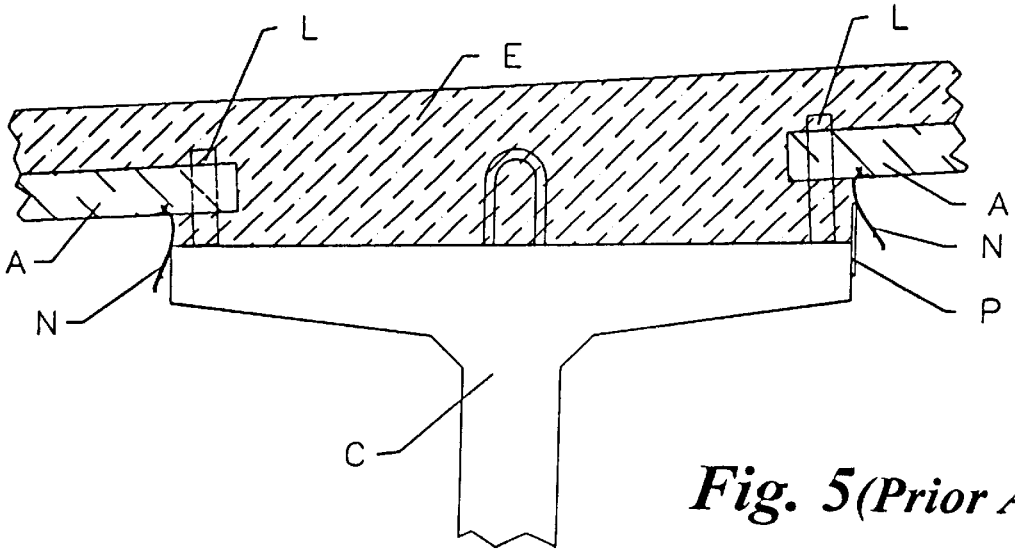
Fig. 5(Prior Art)

FIG. 5 illustrates another typical prior art deck forming apparatus and method for use where the distance between the top of the support beam and the finished grade cannot be achieved within the desired tolerance with the jack bolts L and seal strip N described above. A strip of metal or plastic P is attached as by bonding or welding to the top edge of the beam C to provide a seal for the lower portion of the space between the top of the beam C and the bottom of the panels A. The seal strip N of FIG. 4 then seals to the top edge of the strip P.

Figure 6:
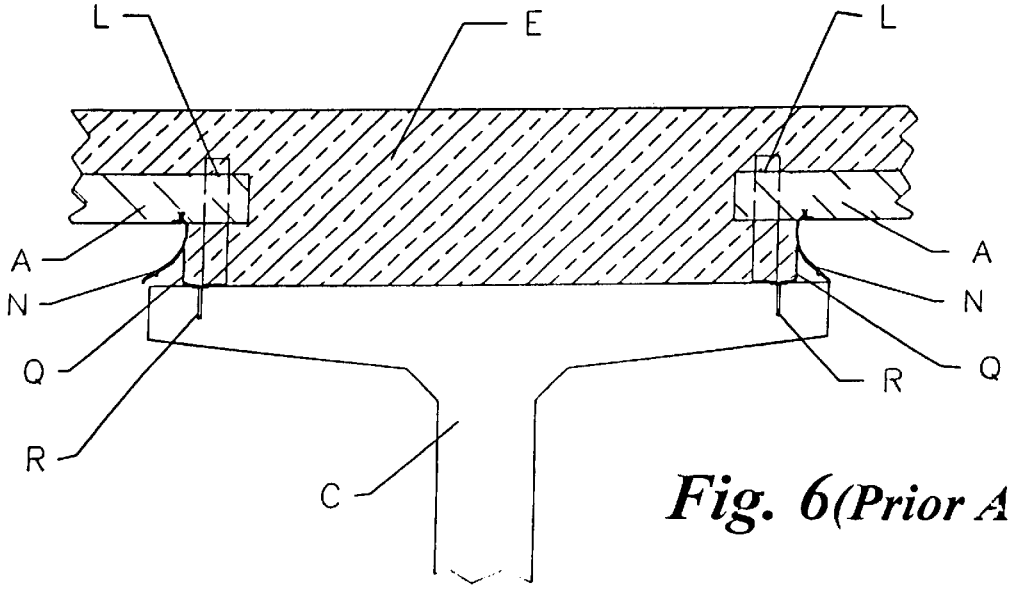
Fig. 6(Prior Art)

FIG. 6 illustrates another typical prior art deck forming apparatus and method for use where the panel A is required to overhang the beam C by a distance greater than can be achieved within desired tolerances provided by the seal strip N of FIG. 4. A metal or plastic angle Q is attached to the top of the beam C as by bonding or welding to insert R at a position that will be directly under the embedded edge of the seal strip N. Seal strip N then seals to the top of the attached angle Q as it typically does to the top edge of the beams.

Figure 7:
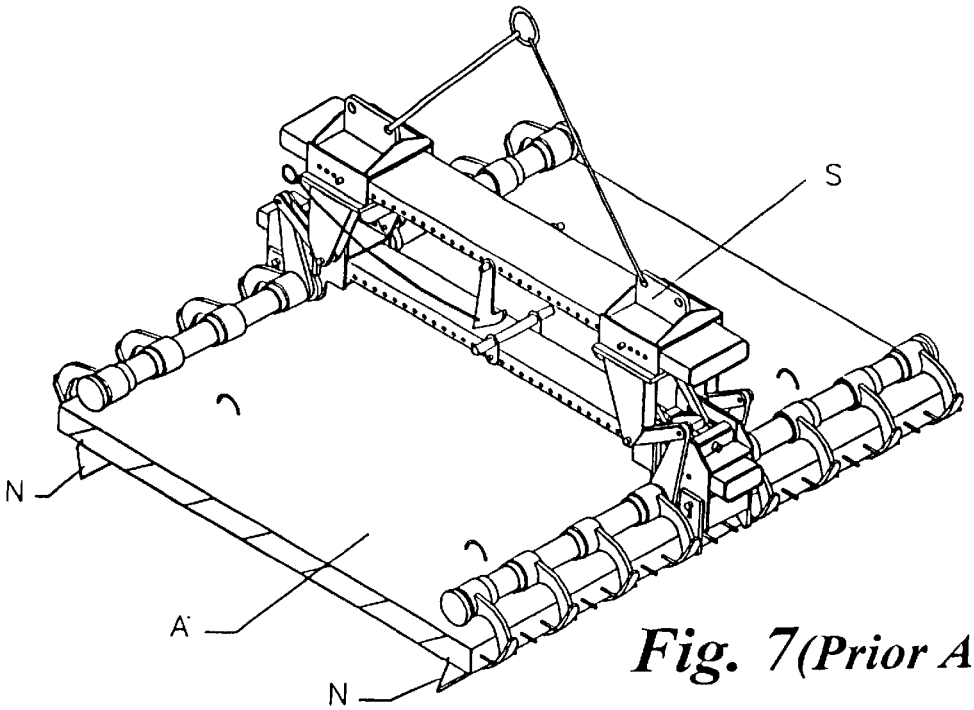
Fig. 7 (Prior Art)
FIG. 7 is an isometric view of the panel of FIGS. 1–6 being lifted for installation on a bridge by the special erection tool of the prior art.
Figure 10:
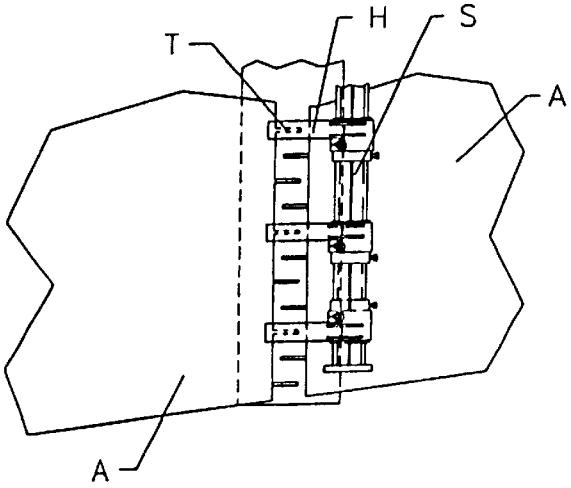
Fig. 10 (Prior Art)
FIG. 10 is a plan view of adjacent panels with misaligned strand extensions.
Figure 8:
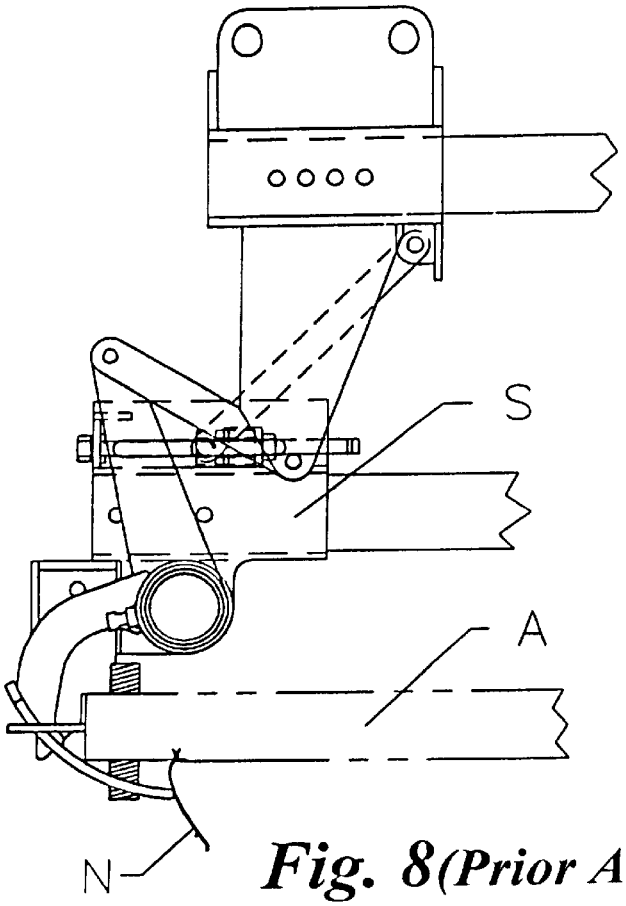
Fig. 8 (Prior Art)
FIG. 8 is a side cross sectional view of the seal strip of the prior art as deflected by the special erection tool.
Figure 9:
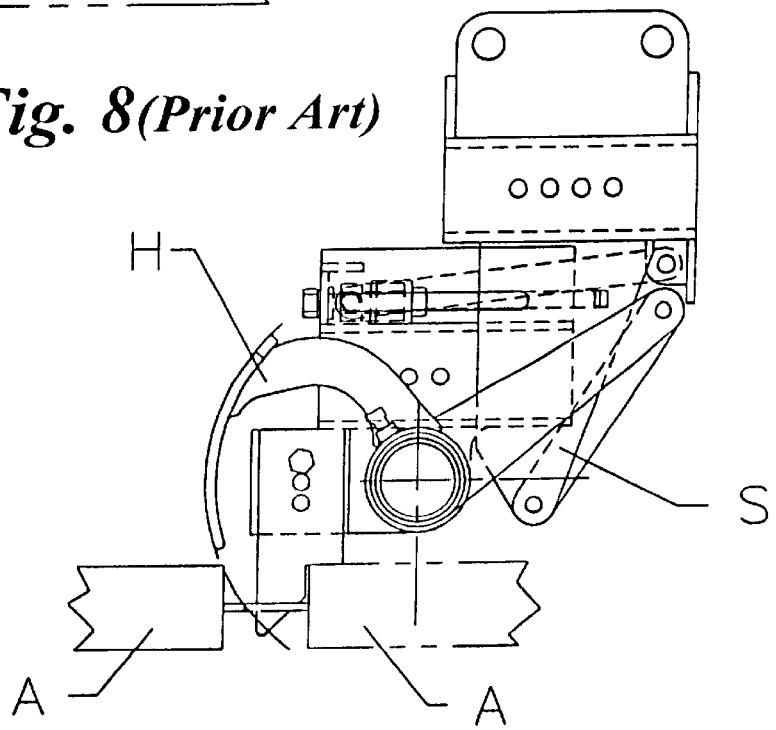
Fig. 9 (Prior Art)
FIG. 9 is a side cross sectional view of the end clearance of the special erection tool of the prior art.

FIG. 7 illustrates another prior art apparatus and method where a special erection tool S is required to support a panel A and deflect seals N to the position where they are ready to install on the support beam. FIG. 8 illustrates in larger detail the special erection tool S of the prior art deflecting seal N to the position where it is ready to be installed on the support beams. FIG. 9 illustrates in larger detail the clearance required between panels A, or other obstacle beyond the end of the panel being erected, for the rotation of tine H of the special erection tool S. FIG. 10 illustrates the interference of reinforcing steel or strand typically extending from the ends of panels A with the tine H of the special erection tool S in the circumstance where the reinforcing steel or strand extending from the ends of adjacent panels do not align with each other.

In the following description, the resilient grout seals and seal strips are preferably formed of a flexible or a relatively stiff resilient plastic material such as polypropylene, polyurethane, polyvinyl chloride, or acrylonitrile-butadiene-styrene terpolymers that will resist bending but will bend to a high deflection without splitting or cracking, and without deformation so that it will spring back to its original position if not restrained from doing so.

Figure 11:
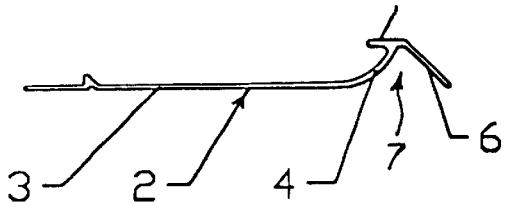
FIG. 11 is a side cross sectional view of a seal strip constructed in accordance with one embodiment of the present invention.
Figure 12:
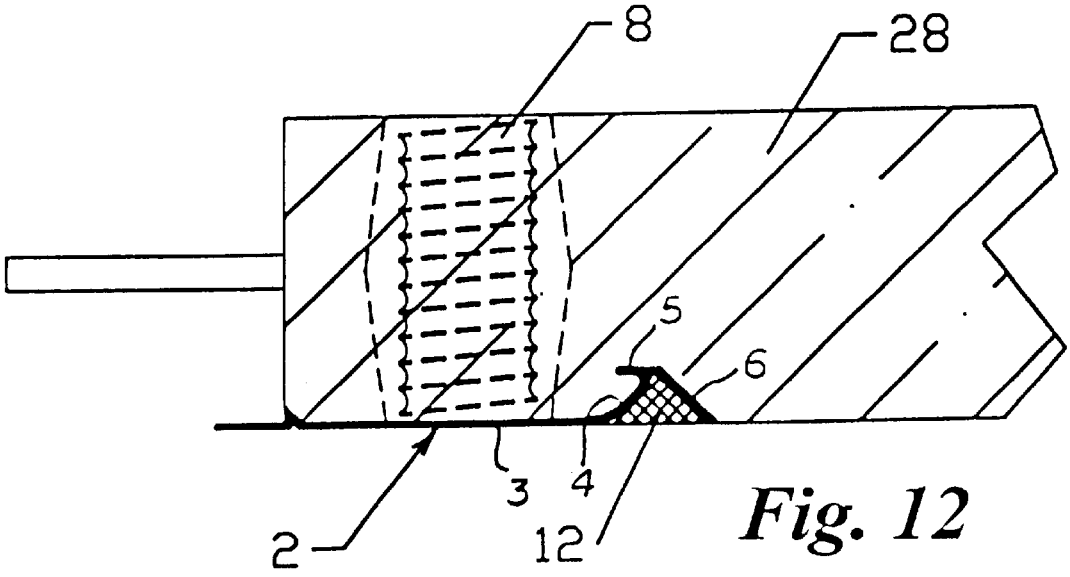
FIG. 12 is a cross sectional view of an end of a panel with the seal strip of FIG. 11 in a position as cast in the bottom of the panel.
Figure 13:
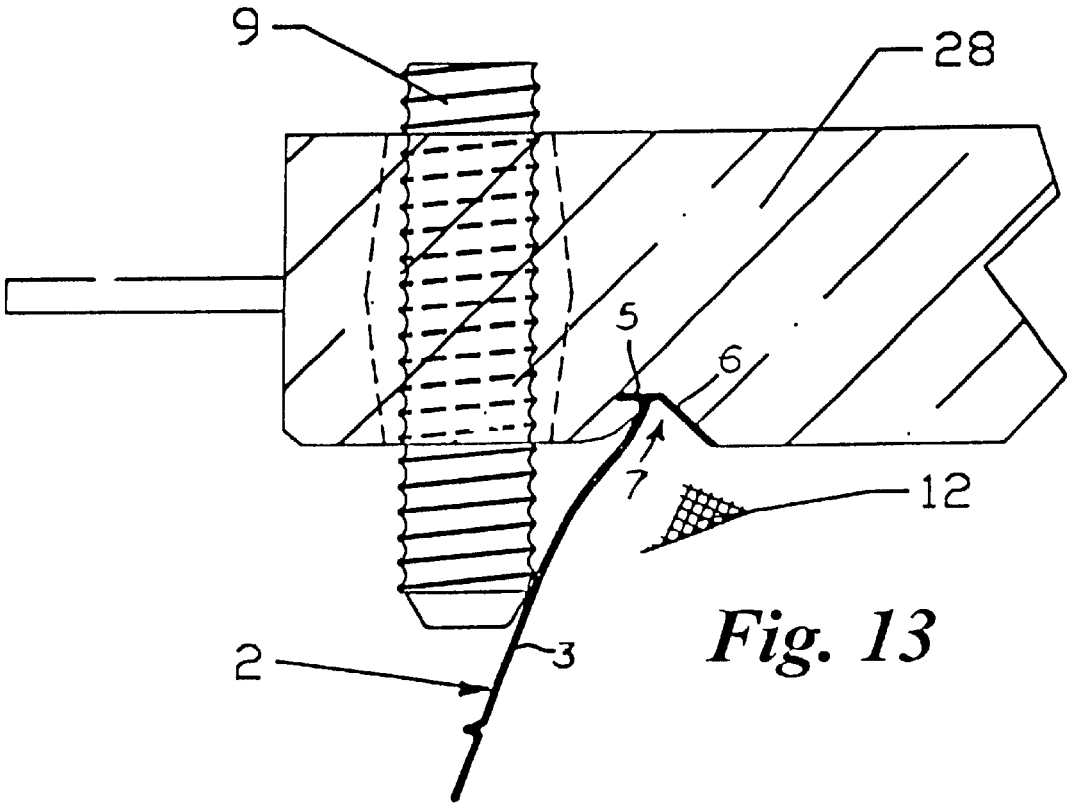
FIG. 13 is a cross sectional view of an end of a panel with the seal strip of FIG. 11 in a position as deflected by a jack bolt of the prior art.

FIG. 11 illustrates a resilient grout seal strip 2 in accordance with one embodiment of the present invention. The seal strip 2 has flat horizontal portion 3, a long radius bend 4, a short horizontal portion 5 at the top thereof, and a downward and outward flat sloping side 6 forming a wide inverted V-shaped cavity 7 when the seal strip is embedded in the bottom surface of a precast concrete panel. The portions 4, 5, and 6 form the anchor channel portion of the seal strip that embeds into the bottom of the concrete panel. The thickness of the resilient plastic material in the radius bend 4 is thickest at its top end and tapers through the radius to the thickness of the flat horizontal portion 3. Any grout which seeps into the wide cavity 7 and hardens will be easily expelled by the deflection of the strip. FIG. 12 shows an end of a precast concrete panel 28 with the seal strip 2 in a position as cast in the bottom of the panel and a threaded insert 8 embedded in the panel above the flat horizontal portion of the seal strip. The cavity of the seal strip 2 is shown filled with leaked-in grout 12. In FIG. 13, a threaded jack bolt 9 is shown threadedly engaged in the insert 8 to deflect the seal strip 2 and expel the hardened grout 12 from the cavity 7 by the deflection. The long radius bend 4, being thickest at the anchor portion and tapering down over a wide portion of the strip, improves the distribution of unit deflection and further minimizes unit stress at any point.

Figure 14:
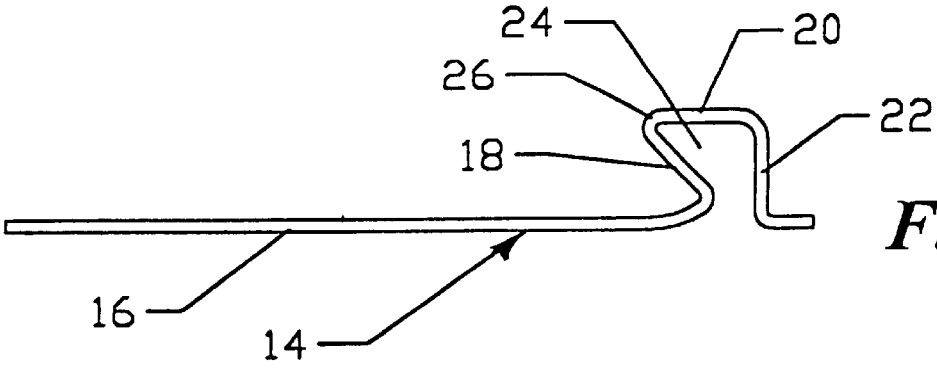
FIG. 14 is a side cross sectional view of a seal strip constructed in accordance with another embodiment of the present invention.
Figure 15:
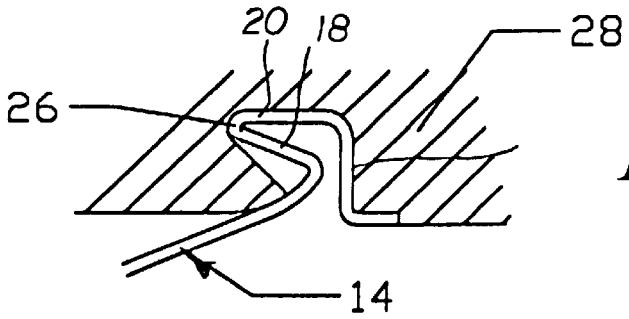
FIGS. 15–17 are side cross sectional views of the hinge portion of the seal strip of FIG. 14 embedded in concrete, in progressive views as the seal strip is deflected in use.
Figure 16:
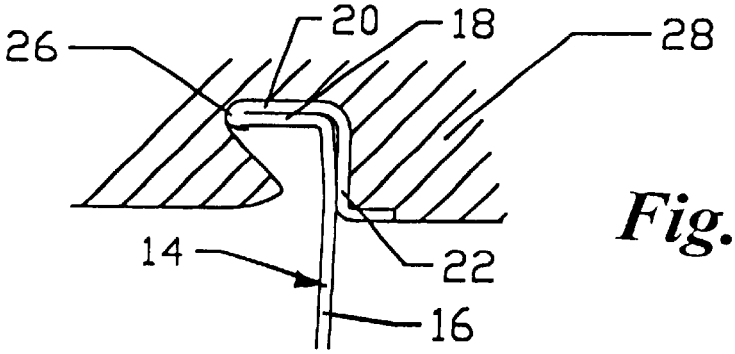
Figure 17:
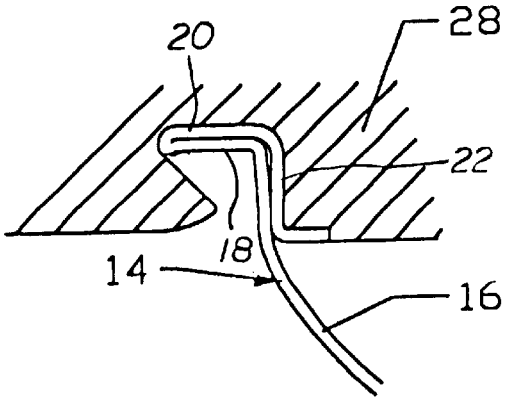

FIG. 14 illustrates another embodiment of the resilient grout seal strip 14 in accordance with the present invention which may be used in situations where the panels are in place for an extended period of time between their erection and the pouring of the cast-in-place concrete, such as erection of the panel during the winter and the pouring of the cast-in-place concrete in the spring. In this embodiment, seal strip 14 has a flat horizontal portion 16, an outer side portion 18 extending angularly upward therefrom, a second shorter horizontal portion 20 at the top thereof, and an inner side portion 22 extending generally vertically downward from the horizontal portion 20. The portions 18, 20, and 22 define an inverted generally triangular wedge-shaped anchor portion that embeds into the bottom of the concrete panel 28 and forms the anchor channel portion of the seal strip. Outer side portion 18 is formed at an angle 24 relative to the shorter horizontal portion 20 and the thickness of the resilient material is indented at their juncture to form a live hinge 26. As shown in FIG. 15, outer side portion 18 along with flat portion 16 can rotate easily about hinge 26 with little bending and stress, but at the desired point of deflection of the seal strip in the erection of the panel 28, outer side portion 18 will contact horizontal portion 20 to stop further rotation about hinge 26 (FIG. 16). At or near that point in the deflection of the seal strip 14, flat portion 16 will contact the generally vertical inner side portion 22 at the bottom of the concrete panel and will bend to provide the remainder of the desired deflection (FIG. 17).

Figure 18:
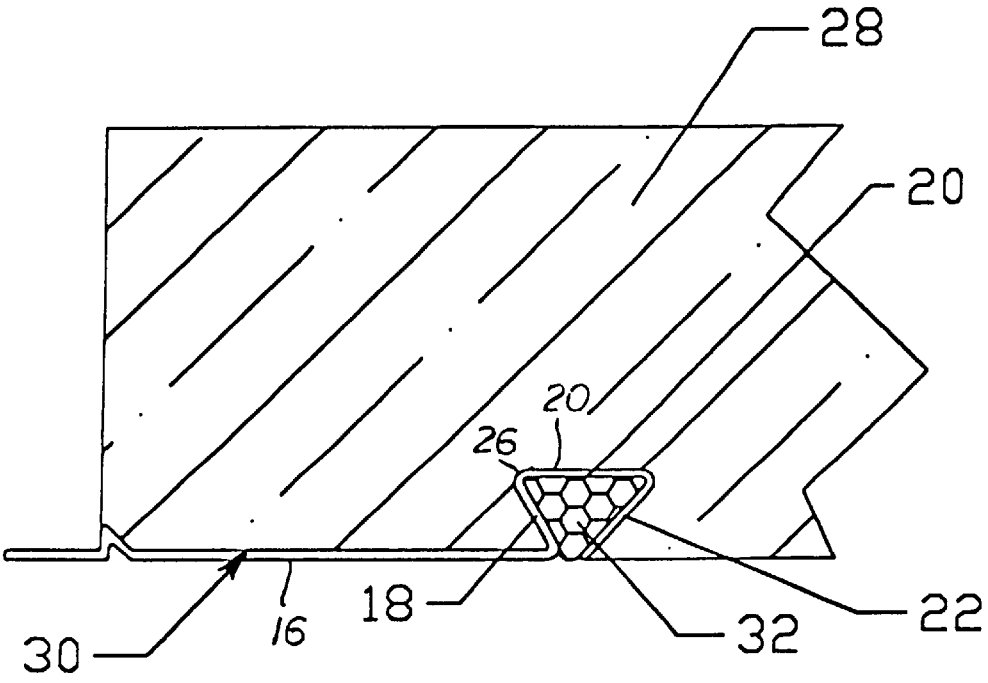
FIGS. 18 and 19 are side cross sectional views of a seal strip constructed in accordance with yet another embodiment of the present invention, embedded in a portion of a panel, as cast and partially deflected.
Figure 19:
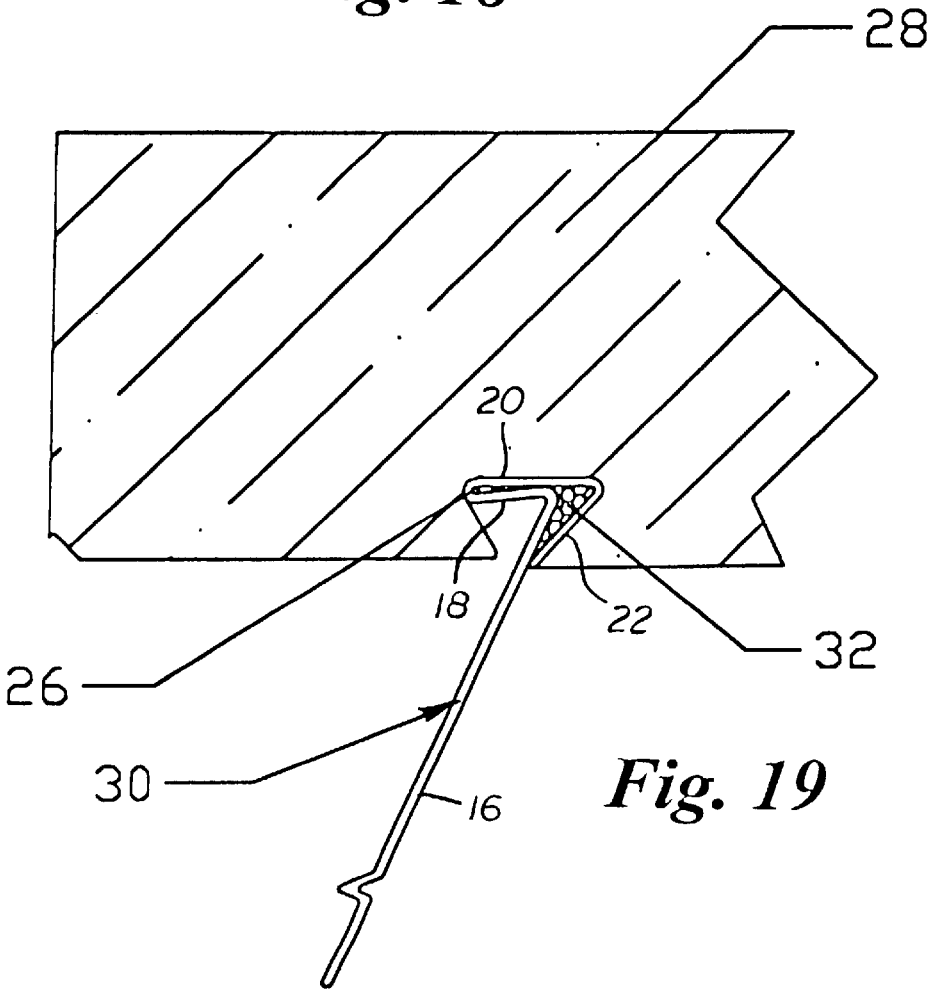

FIGS. 18 and 19 show another embodiment of the resilient grout seal strip 30, similar to the seal strip of FIG. 14, embedded in a precast concrete panel 28. The grout seal 30 has the same flat portion 16, portions 18, 20, 22 forming an inverted anchor channel, and live hinge 26, as previously described. Seal strip 30 differs from seal strip 14 in that the inner side portion 22 is sloped down and toward the end of panel 28 from its juncture with portion 20 to provide an inverted generally triangular wedge-shaped cavity that contains a strip of closed cell foam 32 which prevents grout intrusion during casting of the panel 28. FIG. 18 shows the closed cell foam 32 in its natural state filling the cavity of the inverted channel and thereby preventing grout intrusion. As seen in FIG. 19, when the seal strip 30 is partially deflected as it rotates about hinge 26, the air trapped within the closed cell foam 32 is compressed and the compressed air is contained in the cavity to provide back pressure to force seal strip 30 back against the side of the bridge beam in its intended use. In other words, the air trapped within the closed cells will compress and react about the hinge 26 to provide added load to force the seal strip 30 against the side of the supporting beam and the compressed air will act as a spring that will compensate for any stress relaxation and deformation in the plastic.

For bridges designed with extreme haunch heights, the anchor portion and the seal strip portion of the grout seal strip in accordance with the present invention may be provided as a "two-part" seal made up of an elongate anchor channel, preferrably formed of rigid plastic, and an elongate generally rectangular seal strip, preferrably formed of resilient plastic, that is inserted into it. The anchor channel is secured to or embedded into the bottom of the concrete panel in the casting bed, and provides a slot or channel that will anchor and securely retain the longitudinal edge of the seal strip that is inserted into it. The anchor channel is positioned on a line that will fall approximately over the edge of the supporting beam when the panel is erected. The anchor channel and the seal strip may be of various mating configurations so long as the longitudinal edge of the seal strip has a protrusion or shape that is larger than the opening of the slot in the anchor channel such that the seal strip can be retained.

Figure 20:
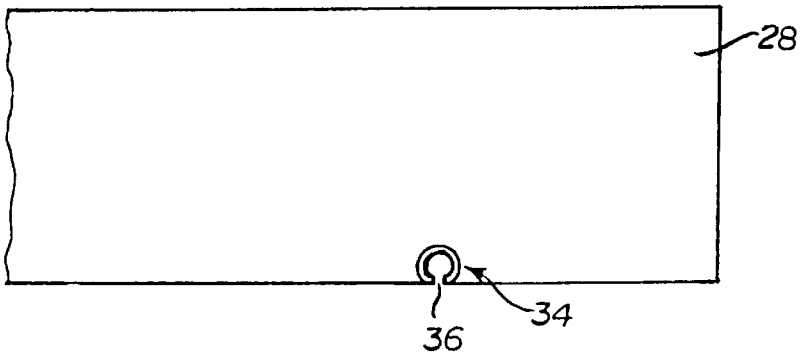
FIGS. 20–23 are side cross sectional views of a portion of a panel with an anchor part of a two-piece seal strip constructed in accordance with yet another embodiment of the present invention embedded therein.
Figure 21:
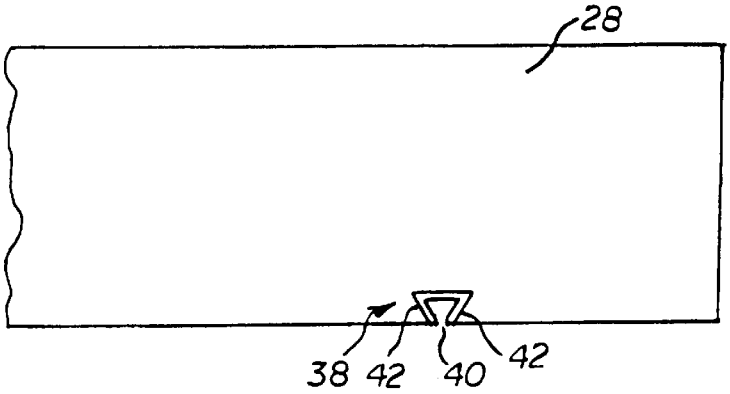
Figure 22:
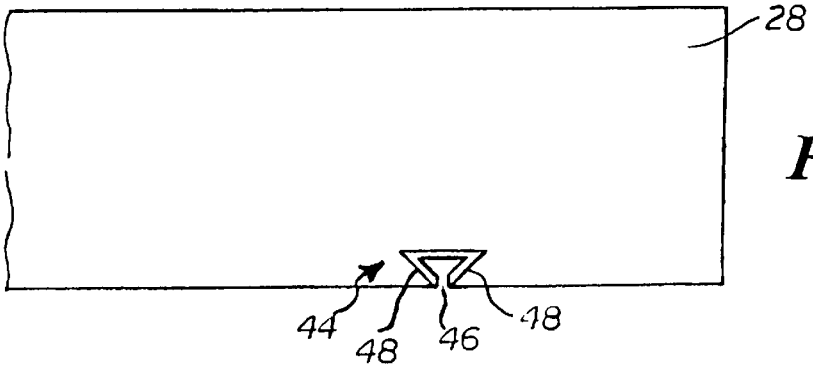

The anchor channel of the present invention can be in the form of a tube with a full length opening turned to the bottom or a hollow wedge shape with the shorter of the parallel sides open to the bottom, that is left in place in the bottom of the panel to receive the seal strip part. For example, in FIG. 20 the anchor channel 34 is shown as a tube embedded in the precast concrete panel 28 with a longitudinal slot 36 open to the bottom face of the panel. In FIG. 21 the embedded anchor channel 38 is shown as a hollow generally triangular wedge configuration having a slot 40 open to the bottom face of the panel 28 and with slightly sloping sides 42 converging downwardly to engage a seal strip (shown and described below with reference to FIGS. 29–32) in a snug wedging fit. In FIG. 22 the embedded anchor channel 44 is shown as a hollow wedge configuration having a slot 46 open to the bottom face of the panel 28, similar to the anchor strip 38, but with more acutely converging sides 48. In these embodiments a seal strip with a protrusion of any shape that is larger than the opening of the slot in the anchor channel strip can be retained in the anchor channel.

Figure 23:
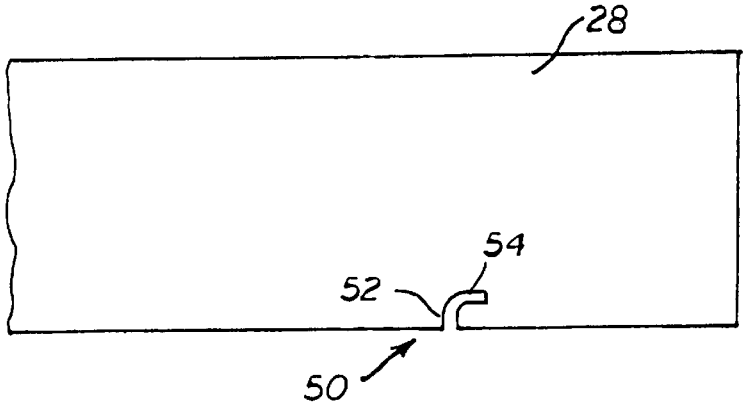

Alternatively, the anchor channel for anchoring the seal strip may be cast into the bottom of the concrete panel, by using a soft or resilient plastic rod, trapezoid, or angle that can be removed from the bottom of the panel after the panel is removed from the casting bed, thereby leaving an anchor slot or channel formed in the concrete to receive the seal strip part. FIG. 23 shows an anchor channel 50 formed into the bottom of the concrete panel 28 in the form of an inverted L-shaped cavity having a generally vertical leg 52 open to the bottom face of panel 28, and a generally horizontal leg 54 extending from the top of the vertical leg in the direction of the end of panel 28.

Figure 24:
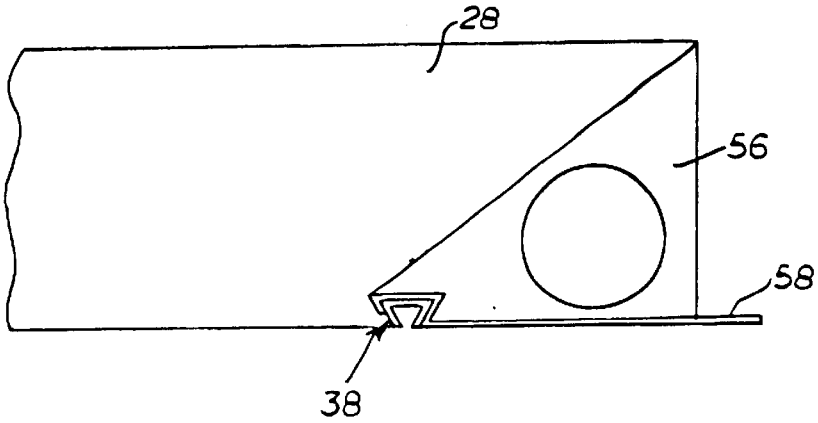
FIGS. 24–26 are side cross sectional views of a portion of a panel with means to install the anchor part of the two-piece seal of FIGS. 20–23.
Figure 25:
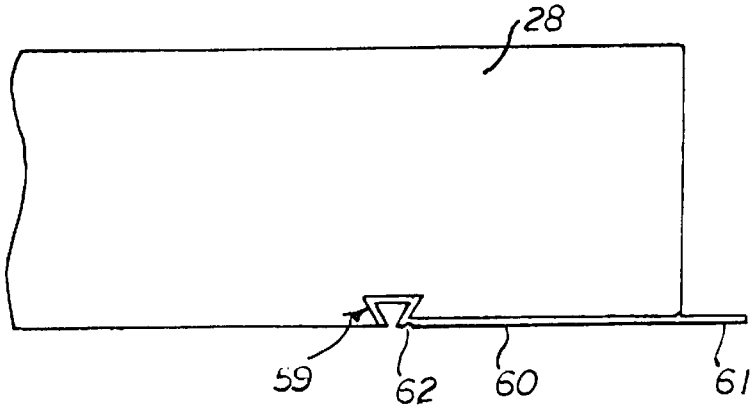
Figure 26:
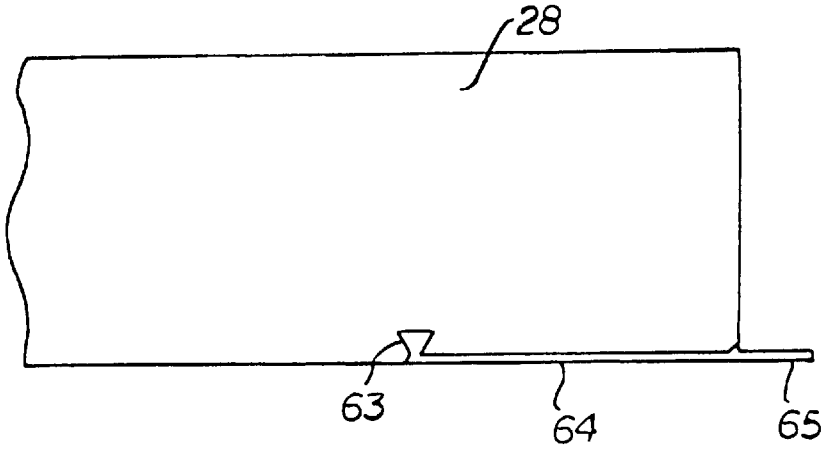

FIGS. 24, 25, and 26 illustrate somewhat schematically methods for positioning and holding the anchor channels in the casting bed through concrete pouring. In preparing the casting bed for a pour, the bottom bulkhead form can be set in place in the bed, and the rigid type of anchor channel can be set in position and held firmly down on the level surface of the form and in place horizontally with plastic or metal brackets spaced along its length and secured to the channel and to the bulkhead form. FIG. 24 shows a rigid wedge-type anchor channel 38 positioned and held by a bracket 56 which attaches to the anchor strip and to the bulkhead form at spaced intervals. The bracket 56 attaches to the bulkhead form by means of a tab 58 which extends under the bulkhead form.

In another method, as seen in FIG. 25, the rigid type of anchor channel can be formed monolithically along one longitudinal edge of a wide flat strip of material, wherein the flat portion is of a width that will position the anchor channel portion at the desired distance from the end of the panel when the opposite edge of the strip is secured under the bulkhead form. The flat strip of material has a wedge-shaped channel portion 59 formed monolithically along a longitudinal edge, an intermediate flat strip portion 60 of sufficient width to position the anchor channel portion, and an outer flat strip extension 61 that extends under the bulkhead form to hold it in position in the casting bed through concrete pouring. The intermediate flat strip portion 60 has a notch 62 near the wedge-shaped anchor portion to create a line of weakness so that the flat strip portions can be neatly and easily torn away and disposed of after the panel 28 has been removed from the casting bed, leaving the wedge shaped channel portion 59 embedded in the concrete.

In another method, as seen in FIG. 26, a resilient removable anchor strip can be used to form an anchor cavity or channel in the bottom of the concrete panel 28 during casting of the panel. In this method, the wide flat monolithic strip with an anchor channel portion along one edge is formed of soft or resilient material. The flat strip of resilient material has a wedge-shaped channel portion 63 formed monolithically along a longitudinal edge, an intermediate flat strip portion 64 of sufficient width to position the anchor channel portion, and an outer flat strip extension 65 that extends under the bulkhead form to hold it in position in the casting bed through concrete pouring. After striping the panel 28 from the form, the monolithic resilient strip including the anchor channel portion 63 can be completely removed from the panel, leaving the anchor slot or channel cavity formed in the concrete, and the resilient strip can be discarded or reused. Although the channel portion 63 is shown as having an inverted generally triangular wedge-shaped cross section, it should be understood that it could be of any suitable anchor shape.

Figure 27:
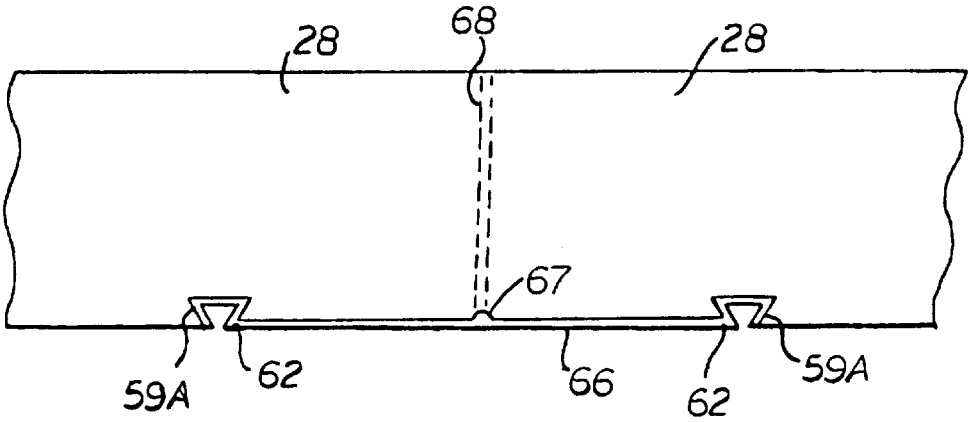
FIGS. 27–28 are side cross sectional views of a portion of adjacent panels with means to install the anchor part of the two-piece seal of FIGS. 20–23 where the panels are cast as a single ribbon and then answered to length.
Figure 28:
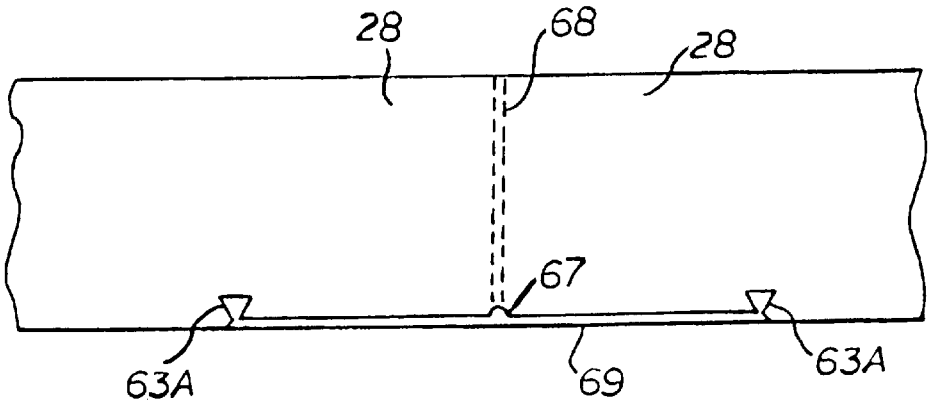

Some panel manufacturers use the so called "slip form" method of casting panels, where the casting bed is poured as one continuous slab and saw cut into panels of the desired lengths after curing. FIGS. 27 and 28 illustrate embodiments of the anchor channel strip that may be used for that casting method, wherein a portion of two adjacent precast concrete panels 28, that were cast as one long slab and then sawed into panels of the desired lengths and the anchor strips have means to position and hold two anchor channels in the casting bed through concrete pouring.

FIG. 27 shows a rigid-type anchor strip similar to that previously described with reference to FIG. 25, but having a wide flat strip portion 66 with two wedge-shaped anchor channel portions 59A, one formed monolithically along each of its opposed longitudinal edges. A centrally disposed raised protrusion 67 extends upwardly from the flat strip portion 66 along its longitudinal center line to line up with the saw cut 68 to be subsequently made after casting and curing of the slab, and the flat strip portion 66 is of sufficient width to position the anchor channel portions 59A at the desired distance from the ends of the subsequently cut adjacent panels through the concrete pouring. The flat strip portion 66 has notches 62 near its juncture with the anchor channel portions 59A to create lines of weakness so the flat strip portion 66 can be neatly and easily torn away after the panels 28 have been removed from the casting bed, leaving the anchor channel portions 59A embedded in the concrete. Anchor channel portions 59A are shown with an inverted generally triangular wedge-shaped cross section, but could be of any suitable anchor shape.

FIG. 28 shows a removable resilient anchor strip for use in the "slip form" casting method, that forms an anchor slot or channel in the concrete panels, similar to that previously described with reference to FIG. 26, but having a wide flat strip portion 69 with two wedge-shaped anchor channel portions 63A, one formed monolithically along each of the opposed longitudinal edges of the resilient strip. A centrally disposed raised protrusion 67 extends upwardly from the flat strip portion 69 along its longitudinal center line to line up with the saw cut 68 to be subsequently made after casting and curing of the slab, and the flat strip portion 69 is of sufficient width to position the anchor channel portions 63A at the desired distance from the ends of the subsequently cut adjacent panels through the concrete pouring. After the panels 28 have been removed from the casting bed, the resilient strip including the anchor channel portions 63A can be completely removed from the panels, leaving the anchor slot or channel cavity formed in the concrete, and the resilient strip can be discarded or reused. Anchor channel portions 59A are shown with an inverted wedge-shaped cross section, but could be of any suitable anchor shape.

As discussed previously, the embedded anchor channels and the anchor slots or channels formed in the concrete panels described above are one part of the "two-part" grout seal that retains an elongate generally rectangular seal strip inserted into it. The seal strip member is a generally flat strip with a protrusion formed on one edge that is shaped to fit into the cavity of the embedded or formed anchor channel in the concrete panel when the seal strip is inserted full length of the panel from one end of the anchor channel. The protrusion is of a size and shape that cannot pass through the slot or opening of the anchor channel so that the seal strip is securely anchored against being removed by the action of an erection tong, the bending of the seal strip to the position preparatory to passing down between the support beams, or the horizontal loads applied by the plastic grout or concrete poured against it. The seal strip is also of a shape that when insert into the anchor channel, the flat portion of the seal strip forms a desired angle with the bottom of the panel. In this way the deflection to the position preparatory to passing down between the support beams is reduced. The deflection stress in the seal strip is thereby reduced and the rebound pressure against the side of the flange of the support beam to provide a seal and resist the horizontal pressure of the plastic grout or concrete poured against it is increased.

Figure 29:
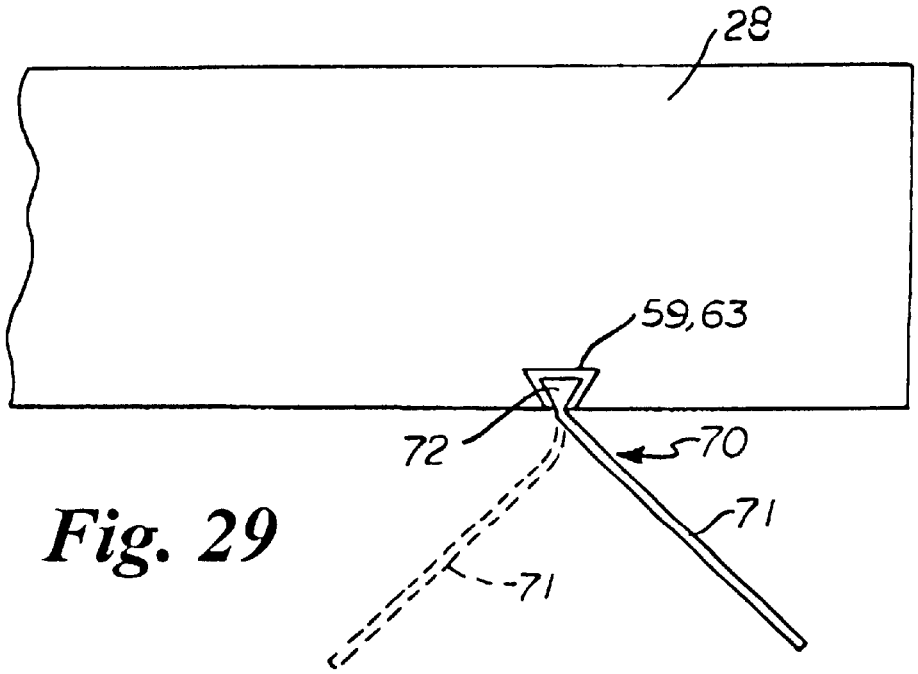
FIGS. 29–32 are side cross sectional views of a portion of a panel with an anchor part of the two-piece seal strip of FIGS. 20–23 embedded therein and with the seal strip part installed as constructed and as deflected.
Figure 30:
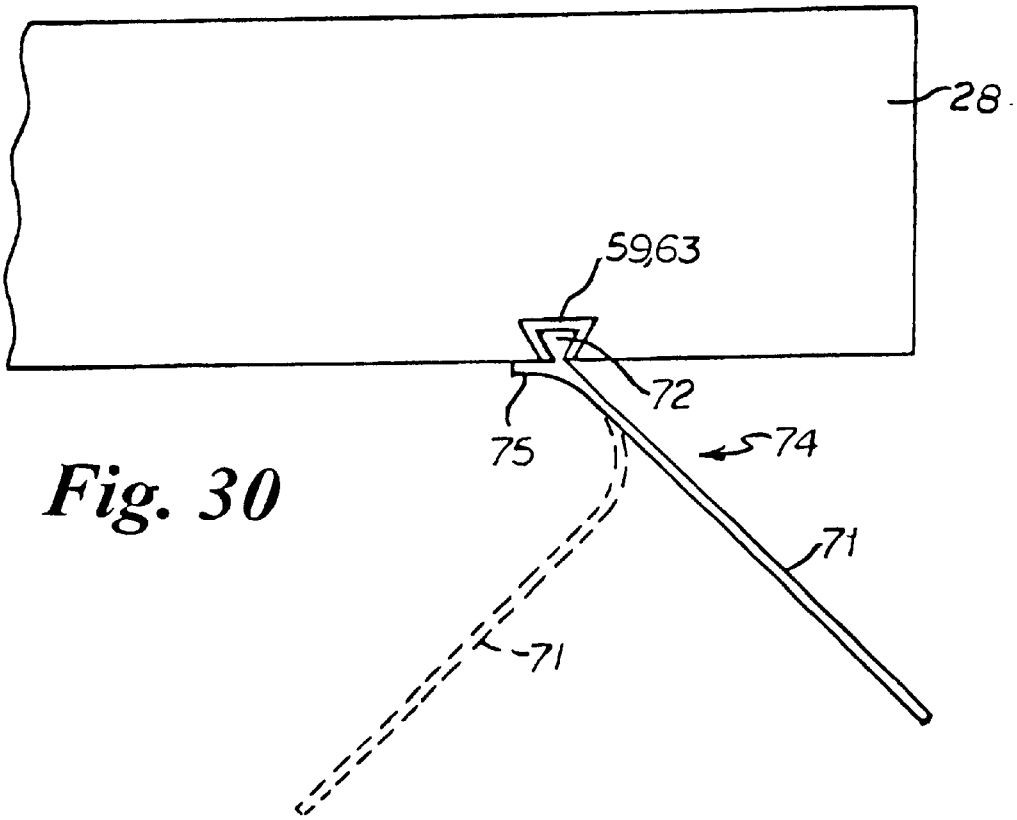
Figure 31:
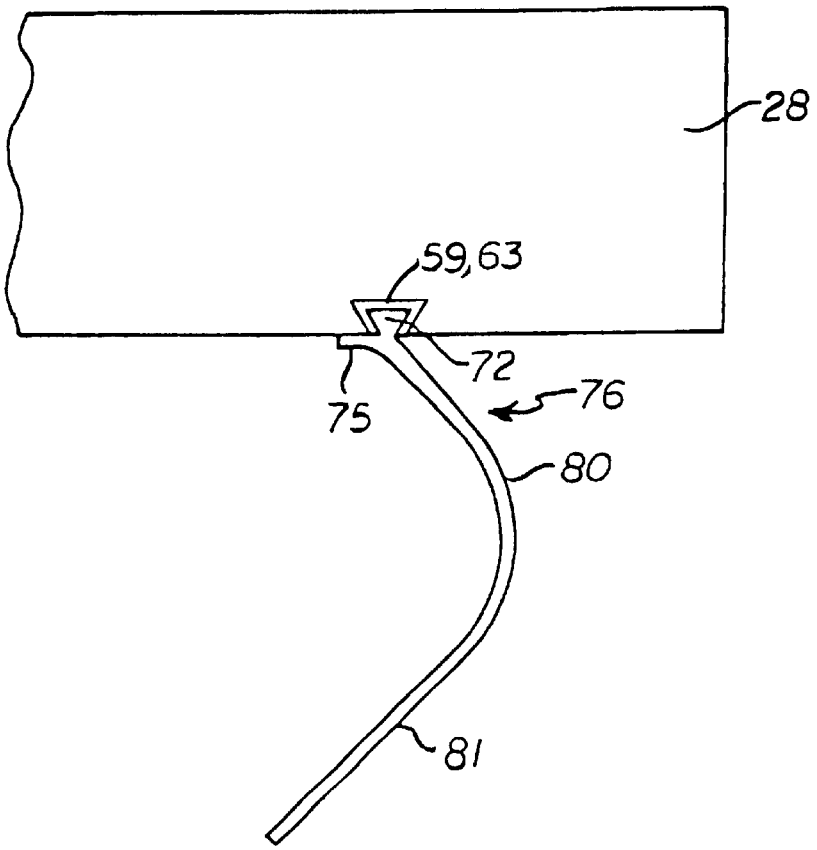

FIGS. 29, 30, and 31 show an anchor channel 59 or 63 of the type discussed above embedded in a precast panel 28 with an elongate generally rectangular seal strip having a protrusion along or near one longitudinal edge inserted therein. In FIG. 29, the seal strip 70, in its unstressed as-formed shape has a flat portion 71 with a wedge-shaped protrusion 72 formed along a longitudinal edge at an angle relative to the flat portion. The flat portion 71 forms an angle relative to the bottom of panel 28 when installed in the anchor channel 59 or 63 so the amount of deflection required to move the seal strip flat portion 71 to a position (shown in dashed line) away from the end of the panel 28 ready to pass down between the support beams in the erection procedure, is minimal. This minimal deflection induces minimal stress in the seal strip 70 and consequently maximum rebound to provide the necessary pressure against the side of the top flange of the support beam to seal against leakage, and resist the horizontal pressure of the grout or concrete that will be poured against it. The anchor channels 59 or 63 and protrusion 72 are shown as having an inverted generally triangular wedge-shaped cross sectional shape, but could be of any suitable anchor shape.

To provide for the higher bending moment applied when the distance between the top of the beam and the bottom of the panel requires a thicker or stiffer seal strip to resist the greater loads involved, the seal strip can be formed with a horizontal extension that will provide a reaction bearing against the bottom of the panel on the side of the strip away from the end of the panel. This modification does not require increasing the size of the anchor channel.

FIG. 30 shows a stiffer seal strip 74 installed in a wedge-shaped anchor channel 59 or 63 embedded in panel 28. The seal strip 74, in its unstressed as-formed shape has a flat portion 71 with a wedge-shaped protrusion 72 formed near the upper longitudinal edge at an angle relative to the flat portion, and an integral horizontal extension heel 75 parallel with the bottom surface of the panel 28. The extension heel 75 engages the bottom of the panel 28 and the flat portion 71 forms an angle relative to the bottom of panel 28 when the protrusion 72 is installed in the anchor channel 59 or 63 so the amount of deflection required to move the seal strip flat portion to a position (shown in dashed line) away from the end of the panel 28 ready to pass down between the support beams in the erection procedure, is minimal. The higher bending moment in the seal strip 74, acting as a cantilever beam, is thereby transferred to the panel 28 by the anchor protrusion 72 acting in tension and the horizontal extension heel 75 acting in compression.

FIG. 31 shows another form of a seal strip having an extension heel 75 and a wedge-shaped protrusion 72 formed along a longitudinal edge which can be installed on the support beams without the use of an erection tool or erection tongs. In this modification, the seal strip 76, rather than having a flat portion, has a curved upper portion 80 extending from the protrusion 72 and a straight lower portion 81. The curved portion 80 curves away from the end of the panel 28 so the straight portion 81 interferes with and is deflected by the edge of the support beam flange as the panel 28 is lowered onto it, and guides the panel to center it between the support beams. When the seal strips are installed at the outer ends of a panel, the free longitudinal edge of the seal strips 76 are positioned inside the flanges of the two support beams that are to support the panel when the panel is in position over them, and the straight portion 81 of the seal strip are at an angle that will guide the panel to center between them as it is lowered on to them. As the panel is lowered further, shape of the remaining portion of the seal strips causes the seal strips to be deflected to bear against the sides of the flanges of the support beams.

Figure 32:
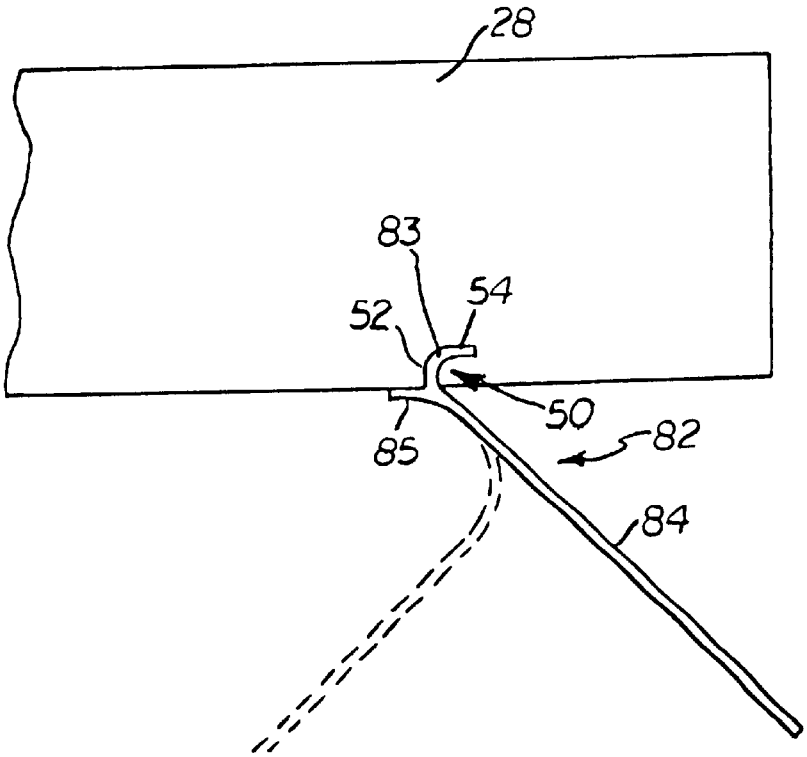

FIG. 32 shows a seal strip 82 installed in an anchor channel cavity 50 which has been formed in the bottom of the panel 28, as discussed previously with reference to FIG. 23. Referring additionally to FIG. 23, the anchor channel 50 is an inverted L-shaped cavity with a generally vertical leg 52 open to the bottom face of panel 28, and a generally horizontal leg 54 extending from the top of the vertical leg in the direction of the end of panel 28. As shown in FIG. 32, the seal strip 82, in its unstressed as-formed shape has an inverted L-shaped protrusion 83 that is received in the slot 50, a wide flat portion 84 extending angularly downward from the protrusion, and a horizontal extension heel 85 parallel with the bottom surface of the panel 28. The extension heel 85 engages the bottom of the panel 28 and the wide flat portion 84 forms an angle relative to the bottom of panel 28. The protrusion 83 of the seal strip 82 can be inserted from the end of the anchor slot 50, as the previously described seal strips would be, or it can be placed under panel 28 with its normally horizontal leg in a vertical position and the now vertical leg can be pushed into the vertical leg 52 of the anchor channel 50 and rolled into the horizontal leg 54 of the anchor channel. Again, the amount of deflection required to move the flat portion 84 of the seal strip to a position (shown in dashed line) away from the end of the panel 28 ready to pass down between the support beams in the erection procedure, is minimal.

Figure 33:
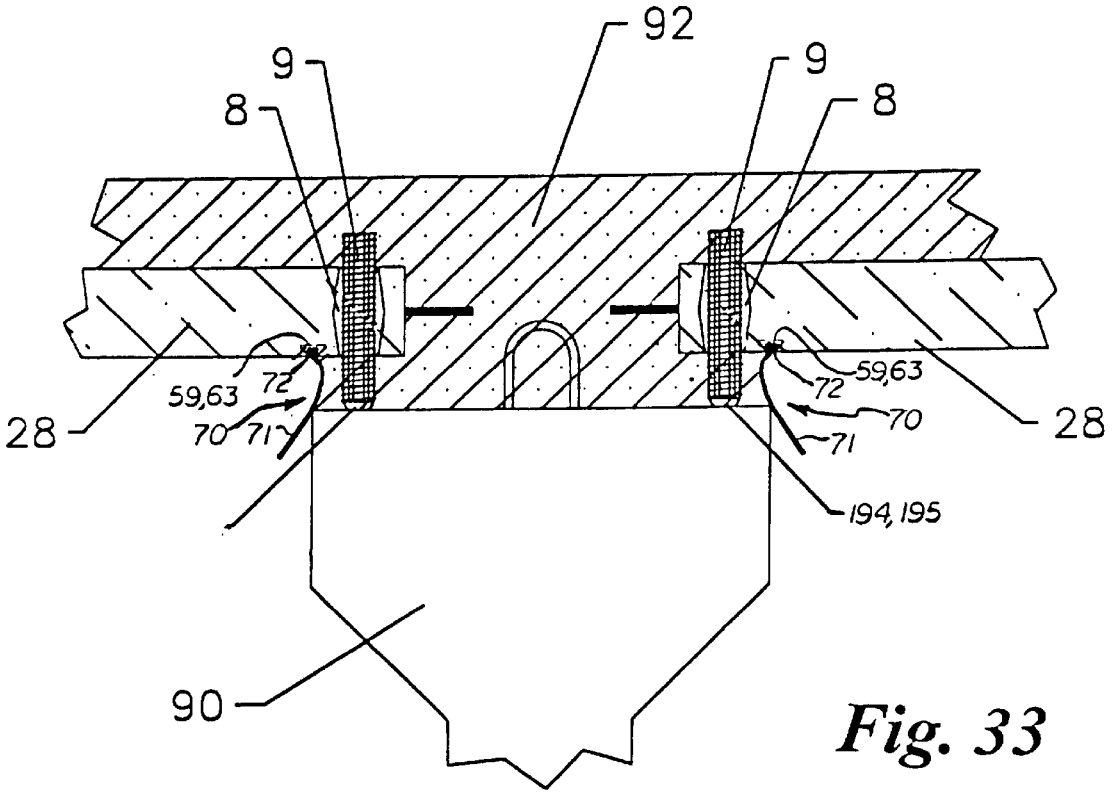
FIGS. 33–35 are side cross sectional views of a beam with screw jacks of the prior art supporting partial panels, and with seal strips of FIGS. 29–32 confining a portion of cast-in-place concrete.
Figure 34:
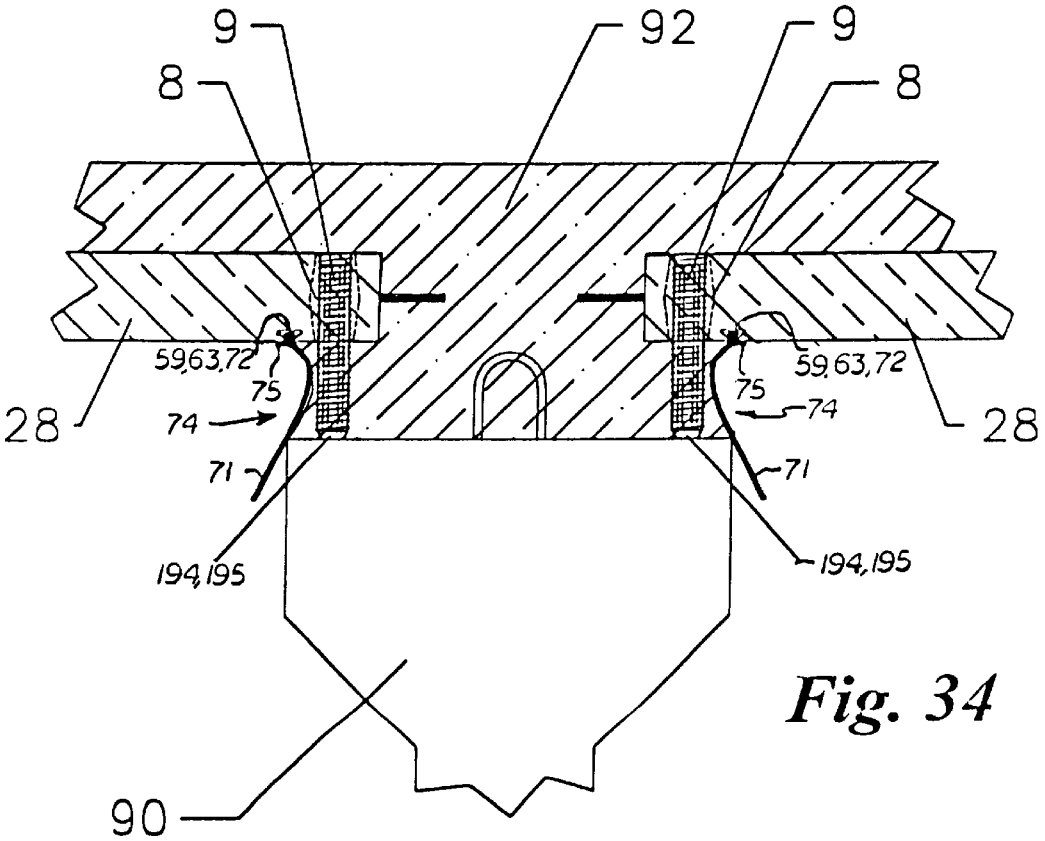

Referring now to FIGS. 33 and 34, there is shown a cast-in-place concrete deck 92 utilizing concrete panels 28 having the previously described "two-piece" grout seals supported on the upper portion of a support beam 90. Modified jack bolts 9 are shown engaged in conventional threaded inserts 8 embedded in the panels 28. The jack bolts 9 have special foot pads 194 or 195 (described hereinafter with reference to FIGS. 59–64). The grout seal shown in FIG. 33 utilizes the embedded wedge-shaped anchor channel 59 or 63 and resilient seal strip 70 of FIG. 29 having a flat portion 71 and wedge-shaped protrusion 72. FIG. 34 shows an installation where there is a greater space between the top of the support beam 90 and the bottom of the panels 28, and utilizes the stiffer resilient seal strip 74 of FIG. 30 having a flat portion 71, wedge-shaped protrusion 72, and horizontal extension heel 75 parallel with the bottom surface of the panel 28.

Figure 35:
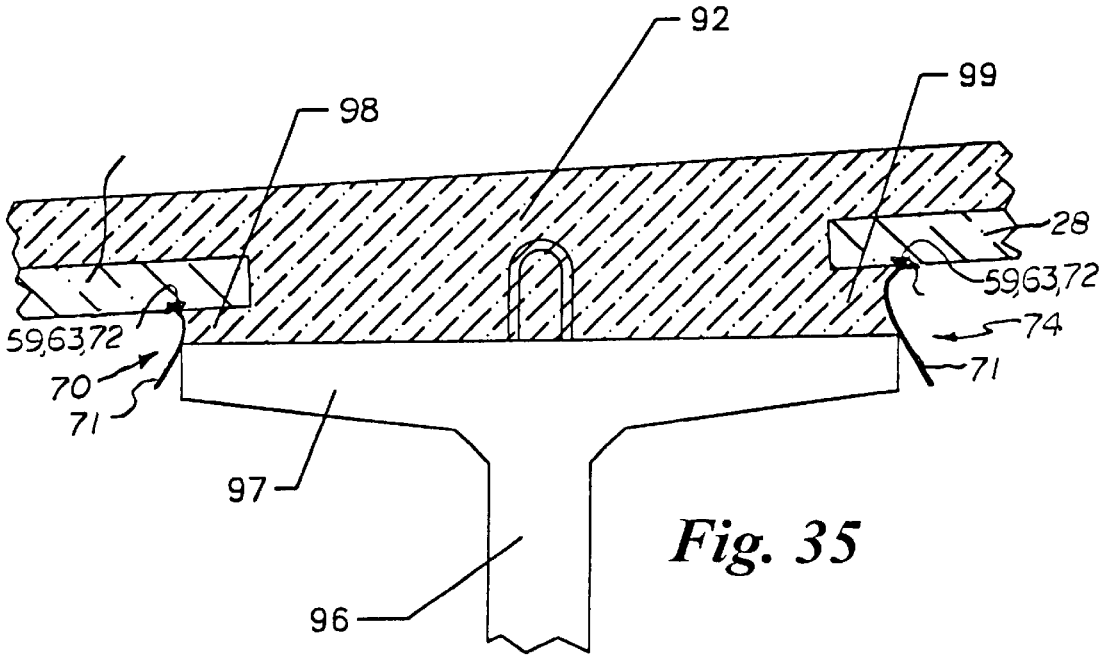

FIG. 35 shows a cast-in-place concrete deck 92 utilizing the previously described concrete panels 28 supported on a support beam 96 with a wide top flange 97 in a situation of high cross slope, as in a super elevation curve, where the space 98 between the top of the support beam on one side of the beam is less then the space 99 on the other side. In this situation, a combination of the previously described seal strips may be used. The same anchor channel 59 or 63 of the two-piece seal is shown on both sides, but the seal strip 70 without the heel extension is shown on the smaller space side 98, and the stiffer seal 74 with the heel extension 75 is shown on the larger space side 99.

For bridges designed with reinforcing steel protruding from the top of concrete beams, or shear studs welded to the top of steel beams, that would interfere with the operation of the erection tong, another embodiment of the grout seal strip in accordance with the present invention may be embedded into the top of the beam in the casting bed, rather than into the panel, or secured to the top edge of the beam at any time prior to the setting of the precast panel.

Figure 36:
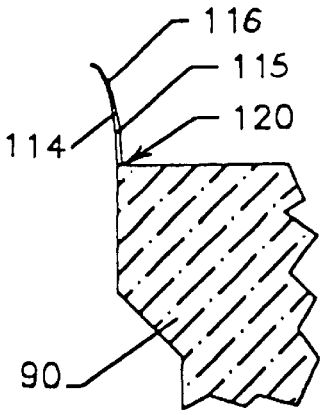
FIG. 36 is a side cross sectional view of a beam and seal strip constructed in accordance with yet another embodiment of the present invention.
Figure 37:
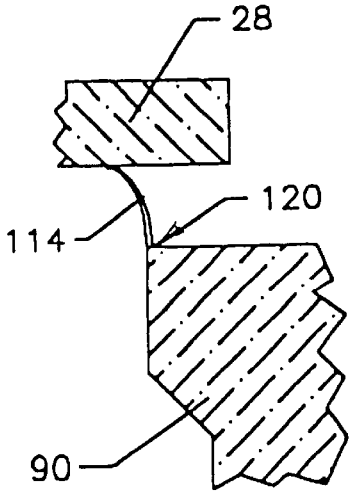
FIGS. 37–38 are cross sectional views of a beam and an end of a panel with the seal strip of FIG. 36 bent to a position engaging the bottom of the panel at differing space between the beam and the panel.
Figure 38:
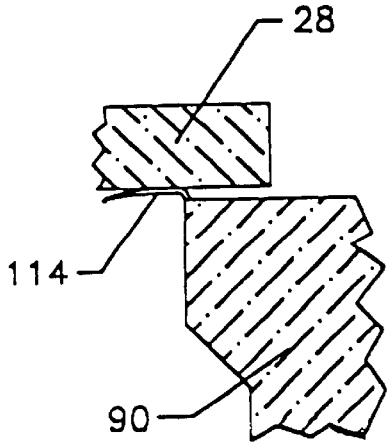

FIGS. 36, 37, and 38 illustrate a corner portion of a support beam 90 and an elongate generally rectangular resilient grout seal strip 114 anchored along one edge at 120 to the support beam. In the erection procedure, the seal strips 114 are positioned on the top outer edges of the support beams for the fall length of the beams. The anchoring details 120 at the lower ends of the seal strips are shown and described hereinafter. The resilient grout seal strip 114 has a flat generally vertical lower portion 115 extending upwardly from its anchored edge and a curved or bent upper portion 116 extending upwardly and outwardly from the outer edge of the beam so it will deflect to the outside under the weight of a panel being lowered down on it. As shown in FIGS. 37 and 38, the precast concrete panel 28 is positioned to span between two desired support beams 90 and is lowered to engage and deflect the resilient grout seal strips 114, to effect a seal to the bottom of the panel until it bears on pre-set threaded bolts or shims (not shown). In FIG. 37 seal strip 114 is shown deflected by and pressed against the bottom of the panel 28 to form a grout or concrete seal at the position of maximum space between the top of the support beam 90 and the bottom of the panel 28. In FIG. 38 the grout seal 114 is shown deflected by and pressed against the bottom of the panel 28 to form the grout or concrete seal at the position of minimum space between the top of the support beam 90 and the bottom of the panel 28.

Figure 39:
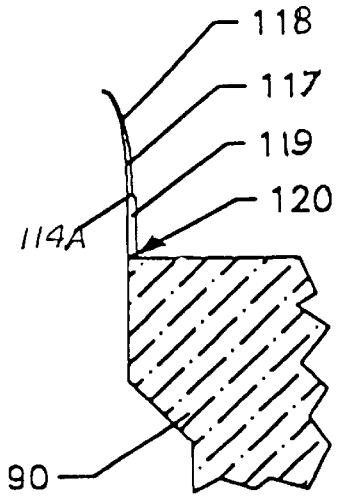
FIG. 39 is a side cross sectional views of a beam and seal strip constructed in accordance with another embodiment of the present invention.
Figure 40:
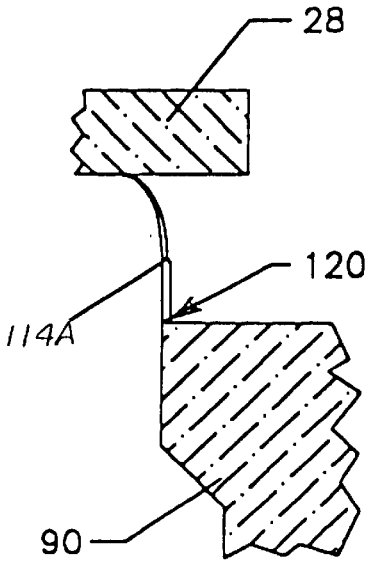
FIGS. 40–41 are cross sectional views of a beam and an end of a panel with the seal strip of FIG. 39 bent to a position engaging the bottom of the panel at differing space between the beam and the panel.
Figure 41:
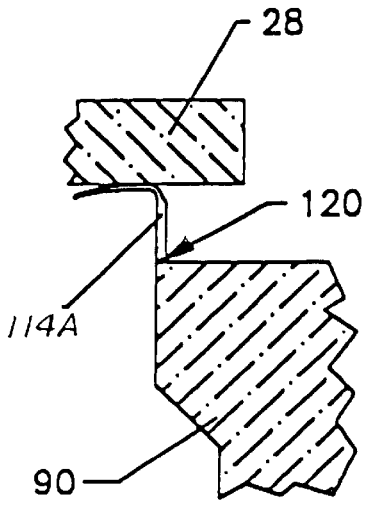

FIGS. 39, 40, and 41 illustrate a modification of the resilient grout seal strip just described which is also anchored along one edge at 120 to the top outer edge of a support beam 90, but is somewhat taller and stiffer. In this modification, the resilient grout seal strip 114A has a flat generally vertical lower portion 117 extending upwardly from its anchored edge and a curved or bent upper portion 118 extending upwardly and outwardly from the outer edge of the beam. A lowermost section of the flat vertical lower portion 117 is thicker in cross section than the remaining portion to form a relatively stiff vertical base portion 119 at its lower end. In FIG. 40 the seal strip 114A is shown deflected by and pressed against the bottom of the panel 28 to form a grout or concrete seal at the position of maximum space between the top of the support beam 90 and the bottom of the panel 28 for seal strip 114A. The addition of the relatively stiff vertical base portion 119 of the seal strip 114A provides for a greater maximum space between the top of the support beam 90 and the panel 28. In FIG. 41 the grout seal 114A is shown deflected by and pressed against the bottom of the panel 28 at the minimum space between the top of the support beam 90 and the panel 28 for seal strip 114A.

Figure 42:
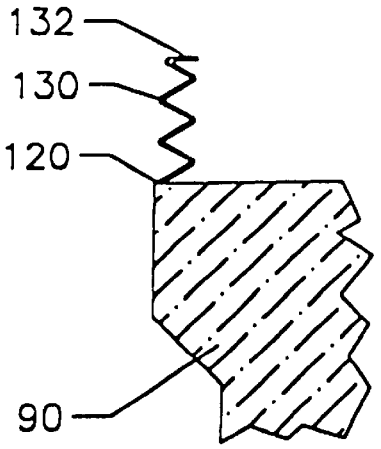
FIG. 42 is a side cross sectional view of a beam and seal strip constructed in accordance with yet another embodiment of the present invention.
Figure 43:
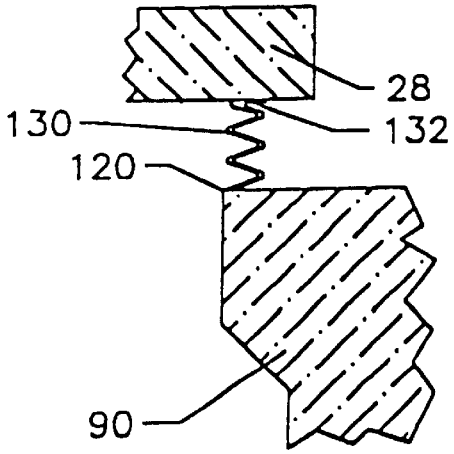
FIG. 43 is a side cross sectional view of a beam and an end of a panel with the seal strip of FIG. 42 bent to a position engaging the bottom of the panel at a space between the beam and the panel.

FIGS. 42 and 43 illustrate another modification of the resilient grout seal strip which is also anchored along one edge at 120 (described hereinafter) to the top outer edge of a support beam 90, but has a different cross sectional configuration. In this modification, the resilient grout seal strip 130 has a cross section which is zigzagging in an accordion style to provide vertical flexibility to adjust to the variable space between the top of beam 90 and the bottom of panel 28. The top surface 132 of the strip 130 is flat so as to bear against the bottom surface of panel 28, and can be coated with a contact bonding material to increase its resistance to being displaced by the pressure of the concrete or grout poured against it. In FIG. 43 the grout seal strip 130 is shown deflected by and pressed against the bottom of the panel 28 to form a grout or concrete seal.

Figure 44:
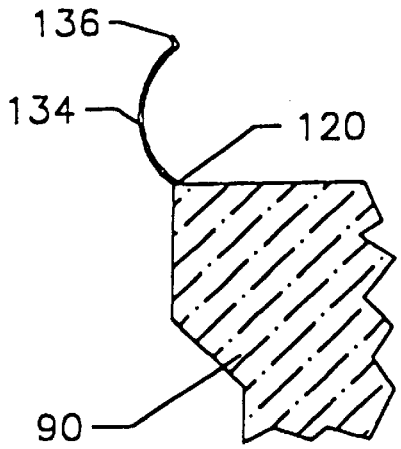
FIG. 44 is a side cross sectional view of a beam and seal strip constructed in accordance with yet another embodiment of the present invention.
Figure 45:
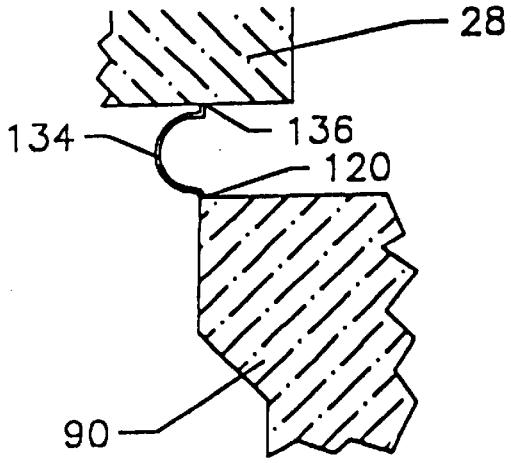
FIG. 45 is a side cross sectional view of a beam and an end of a panel with the seal strip of FIG. 44 bent to a position engaging the bottom of the panel at a space between the beam and the panel.

FIGS. 44 and 45 illustrate still another modification of the resilient grout seal strip which is also anchored along one edge at 120 (described hereinafter) to the top outer edge of a support beam 90, and has a different cross sectional configuration. In this modification, the resilient grout seal strip 134 has a curved profile which curves upwardly and outwardly from its anchored edge and then back inwardly toward the outer edge of the beam 90 and has a sharp protrusion 136 at its top edge to contact and grip the bottom surface of panel 28. In FIG. 45 the seal strip 134 is shown deflected by the bottom of the panel 28 with the protrusion 136 gripping it to form a grout or concrete seal.

The resilient grout seal strips 114, 115, 130, and 134 are preferrably formed of a resilient relatively stiff plastic material (e.g. polypropylene, polyurethane, or acrylonitrile-butadiene-styrene terpolymers) that resists bending but will bend to a high deflection without splitting or cracking, and without deformation so that it will press against the bottom of the panel through the full range of adjustability.

Alternatively, as described below, the grout seal strips which are anchored to the beams may be formed of a highly compressible material (e.g. polyurethane, or rubber foam) that will compress to a high deflection while continuing to press against the bottom of the panel through the full range of adjustability.

Figure 46:
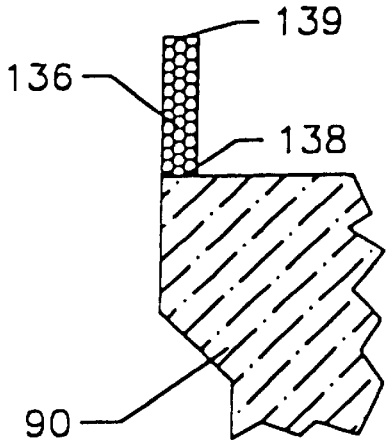
FIG. 46 is a side cross sectional view of a beam and seal strip constructed in accordance with yet another embodiment of the present invention.
Figure 47:
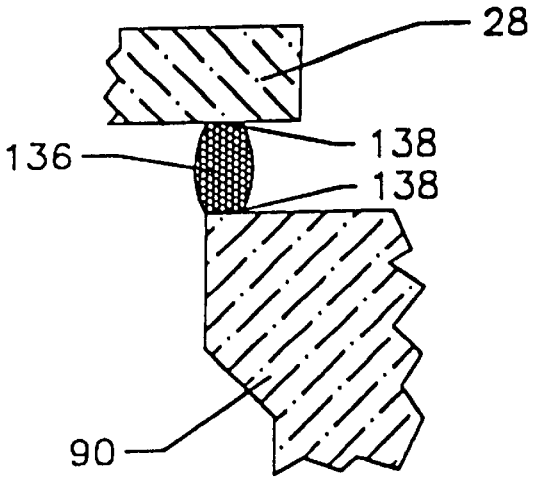
FIG. 47 is a side cross sectional view of a beam and an end of a panel with the seal strip of FIG. 46 compressed to a position engaging the bottom of the panel at a space between the beam and the panel.

FIGS. 46 and 47 illustrate a portion of a support beam 90, a portion of a precast pre-stressed concrete panel 28, and a resilient grout seal 136 made of a highly compressible material to provide vertical flexibility to adjust to the variable space between the top of beam 90 and the bottom of panel 28. The grout seal 136 has a flat bottom surface anchored to the top outer edge of the support beam 90 by a bonding material 138 and a flat top surface 139 which bears against the bottom of the concrete panel 28, and can be coated with a contact bonding material to increase its resistance to being displaced by the pressure of the concrete or grout poured against it. In FIG. 47 the seal strip 136 is shown deflected by and pressed against the bottom of the panel 28 to form a grout or concrete seal.

Figure 48:
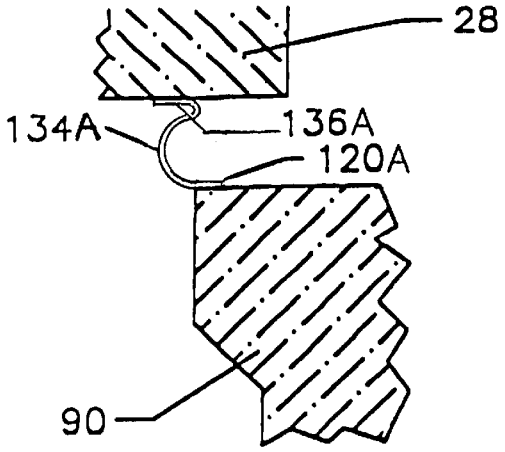
FIGS. 48 and 49 are side cross sectional views of flexible seal strip attached between an end of a panel and the top surface and side surface of a beam, respectively.
Figure 49:
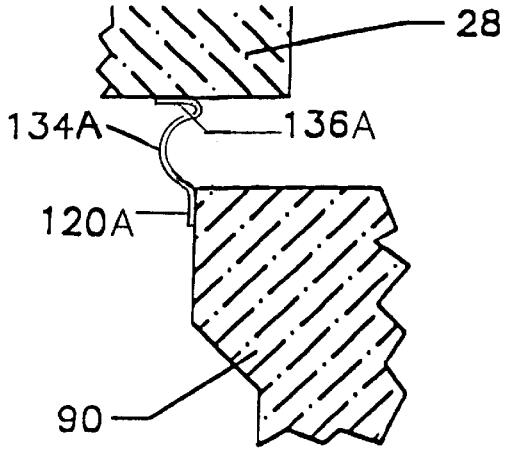

FIG. 48 shows a portion of a support beam 90, a portion of a precast pre-stressed concrete panel 28, and a resilient grout seal 134A, similar to the embodiment of FIG. 46, but made of a thin flexible material to provide sufficient flexibility to adjust to the variable space between the top of beam 90 and the bottom of panel 28. The grout seal 134A has a first anchoring portion 136A extending along a first longitudinal edge and a second anchoring portion 120A extending along a second longitudinal edge, and a flexible mid portion extending therebetween. The first anchoring portion 136A is anchored on the bottom surface of the precast panel 28 adjacent to its longitudinal edge and the second anchoring portion 120A is anchored to the top surface of the support beam 90 by a bonding material. FIG. 49 shows the flexible grout seal strip seal 134A having its first anchoring portion 136A anchored on the bottom surface of the precast panel 28 adjacent to its longitudinal edge and the second anchoring portion 120A anchored to the outer side surface of the support beam 90 by a bonding material.

Figure 50:
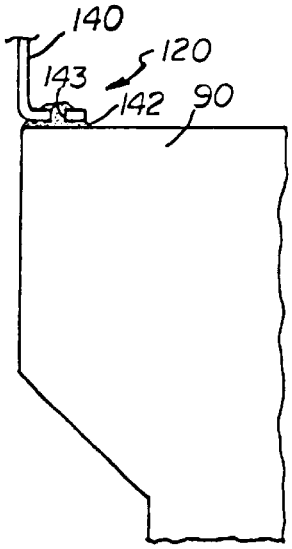
FIGS. 50–56 are cross sectional views a beam with the attachment detail of the seal strip constructed in accordance with one embodiment of the present invention.
Figure 51:
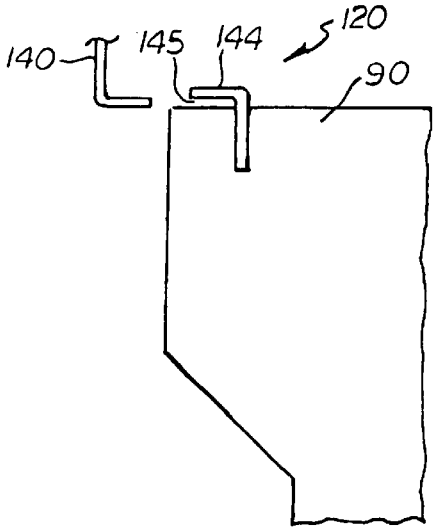

FIGS. 50, 51, 52, 53, 54, and 55 illustrate somewhat schematically various methods by which the previously described resilient seal strips of FIGS. 36 through 45 may be anchored to the support beam 90. In FIG. 50 the lower anchor portion 140 of the grout seal is bent back horizontally in an L-shape over the top of support beam 90 and may have holes 143 formed in the horizontal portion at spaced intervals. A bonding material such as epoxy 142 is spread on the top edge of the support beam 90. The horizontal portion of seal strip 140 is pressed onto the bonding material, and the material is forced up through the holes 143, to securely anchor the seal strip 140 to the top of support beam 90. In FIG. 51 the vertical leg of a metallic or plastic angle 144 is embedded in the top of the support beam 90, when the beam is cast, and positioned with a space 145 between its horizontal leg and the top of the beam to receive the horizontal portion of the L-shaped lower anchor portion 140 of the seal strip to anchor it securely to the top of the support beam 90.

Figure 52:
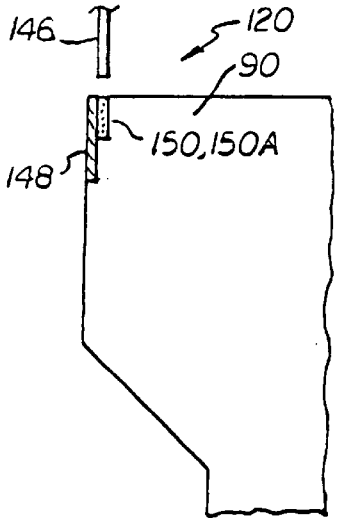
Figure 53:
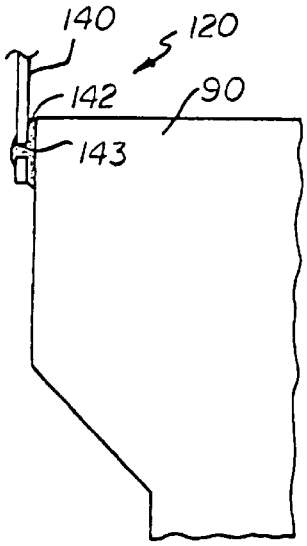
Figure 54:
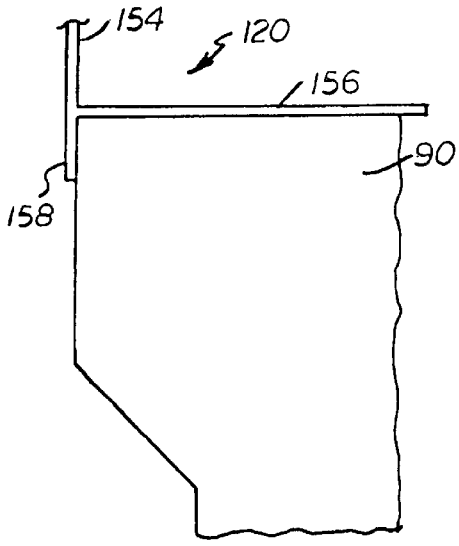
Figure 55:
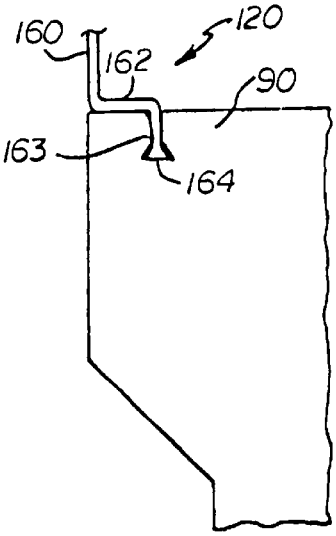

In FIG. 52 the seal strip has a straight lower anchor portion 146. A metallic or plastic flat strip 148, with a laterally adjacent strip of pliable or resilient material 150, such as plastic foam, is embedded full length in the top edge of support beam 90 when the beam is cast. At a convenient time, after casting and before panel erection, the pliable or resilient material 150 is removed by peeling or by air or water jet to leave a slot or cavity in the beam 90, and the seal strip lower end 146 is inserted in the slot or cavity. In FIG. 53 the straight lower anchor portion 140 of the seal strip extends below the top of the support beam 90 and has holes 143 formed therethrough at longitudinally spaced intervals. A bonding material such as epoxy 142 is spread on the top outside edge of the support beam 90. The lower anchor portion 140 of the seal strip is pressed to it and the bonding material 142 is forced through the holes 143 to securely anchor the seal strip to the top of the support beam 90. In FIG. 54 the lower anchor portion 140 of the seal strip has a plurality of integral longitudinally spaced horizontal strap portions 156 that lay across the top of support beam 90 at spaced intervals. A vertical extension 158 extends full length of the beam below the strap 156 to position the seal strip, to prevent concrete from flowing between the seal strip lower end 154 and the support beam 90, and to prevent horizontal movement of the seal strip due to loads applied to the seal strip on the opposite edge of the support beam 90. In FIG. 55 the lower anchor portion 160 of the seal strip has a horizontal portion 162 that extends over the top of the support beam 90 and a vertical portion 163 extending back down vertically with an enlarged bottom end 164 for anchorage. In this embodiment, the lower anchor portion 163, 164 of the seal strip 160 is embedded into the top of the support beam 90 at the time it is cast.

Figure 56:
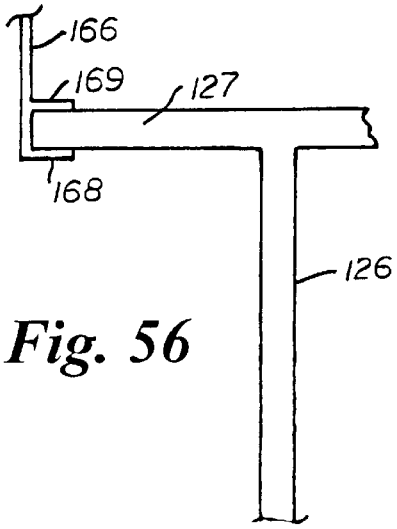

When used with structural steel beams, the resilient grout seal strips may be bonded to the top edge or side of the top flange, or may be molded with a pair of horizontal extensions that fit under and over the flange plate in a tight fit, or be secured with straps from the strip on one edge across the beam to the strip on the opposite edge at spaced intervals along the beam. In FIG. 56 the lower anchor portion of the seal strip 166 extends downward past the under side of a relatively thin top flange 127 of a typical structural steel beam 126. A horizontal extension 168 at the bottom of the seal extends a short distance under the top flange 127 and similar horizontal extension 169 is spaced above the lower extension 168 to provide a tight frictionally engaged fit on the edge of the top flange 127, thereby providing a secure anchor of the seal strip 166 to the top of the support beam 126.

Figure 57:
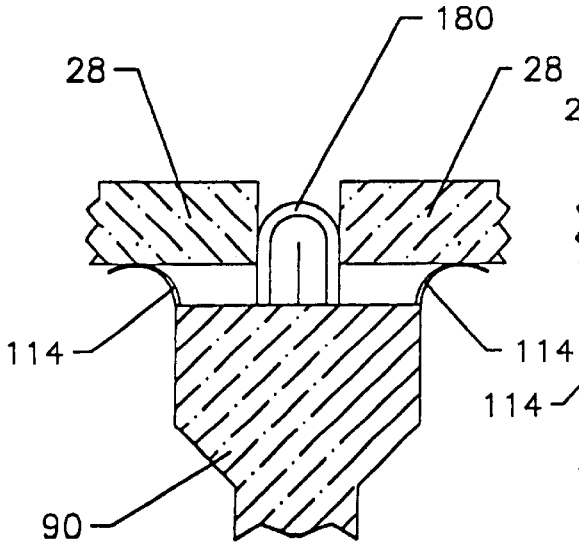
FIGS. 57–58 are cross sectional views of a narrow top beams and end views of panels, with obstacles extending from the tops of the beams, and seal strips bent to engage the bottom of the panels.
Figure 58:
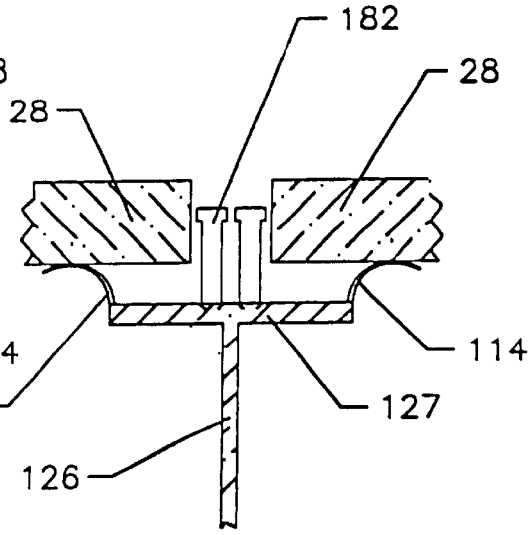

FIGS. 57 and 58 illustrate a portion of a precast concrete support beam 90 and a structural steel support beam 126, respectively, having obstacles protruding from their upper surface and each having the previously described grout seal strips 114 (FIG. 36) anchored to their outer edges and engaged with the bottom surface of the precast panels 28. The obstacles shown represent severe problems in the most recent prior art method used to provide for variable space between the top of the support beam and the bottom of the panel in the use of precast panels but are no problem in the use of the present invention. In FIG. 57 a reinforcing steel bar loop 180 is embedded in and protrudes from the top of a precast concrete support beam 90. Panels 28 are placed against either side of the loop 180. In FIG. 58 shear studs 182 are attached, as by welding, to the top flange 127 of structural steel support beam 126. Panels 28 are placed in close proximity of the shear studs 182. In both installations, the seal strip 114 is shown deflected by and pressed against the bottom of the panel 28 to form a grout or concrete seal at the position of maximum space between the top of the support beam 90 and the bottom of the panel 28.

Figure 59:
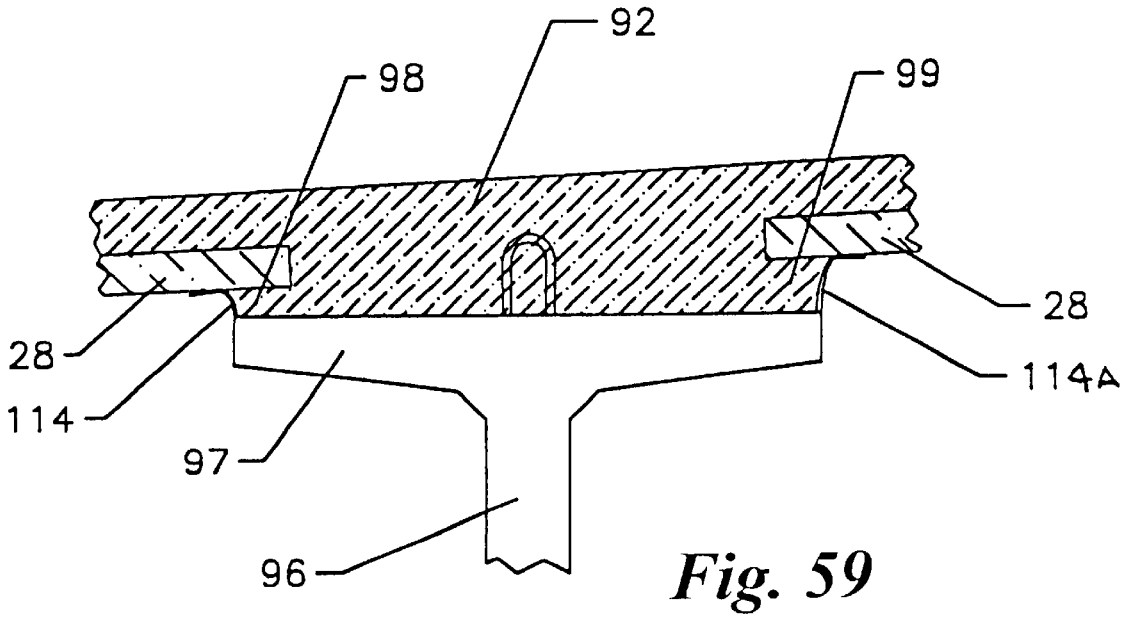
FIG. 59 is a side cross sectional view of a beam, panel ends, and a portion of the cast-in-place concrete with seal strips of FIGS. 36 and 39 bent to engage the bottoms of the panels.

FIG. 59 illustrates a portion of another precast concrete support beam 96 with a wide top flange 97, portions of the concrete panels 28, and cast-in-place concrete 92 therebetween, and the previously described seal strips 114 and 114A (FIGS. 36 and 39) anchored to the beam. Due to roadway super elevation, the cross slope grade is substantial and due to the width of the top flange 97 of support beam 96 the space 98 between the top of the support beam 96 at one edge is substantially less then the space 99 at the opposite edge. The shorter seal strip 114 of FIG. 36 is used at the smaller space 98 and the taller stiffer seal strip 114A of FIG. 39 is used at the larger space 99.

Figure 60:
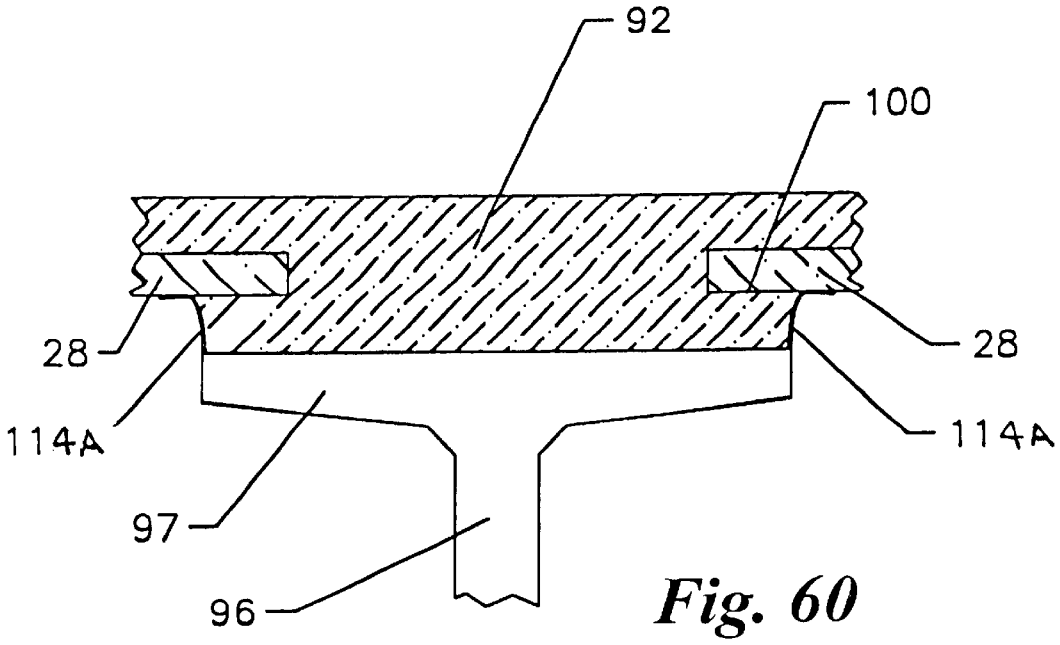
FIG. 60 is a side cross sectional view of a beam, panel ends, and a portion of the cast-in-place concrete with seal strips of FIG. 39 bent to engage the bottom of the panels.
Figure 63:
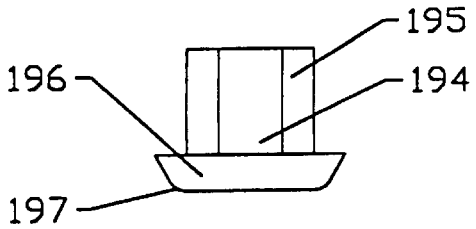
FIG. 63 is a side elevation view of an attachable foot for the threaded jack bolt of the prior art in accordance with one embodiment of the present invention.
Figure 64:
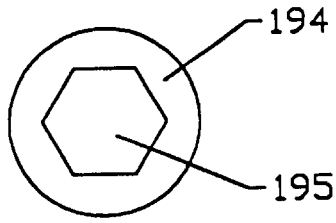
FIG. 64 is a top plan view of an attachable foot for the threaded jack bolt of the prior art in accordance with one embodiment of the present invention.

FIG. 60 illustrates a portion of a precast concrete support beam 96, portions of concrete panels 28 with cast-in-place concrete 92 therebetween, and seal strips 115 (FIG. 39) anchored to the edges of the beam. Due to variations of design of the precast concrete beams 96, especially in the reinforcing steel, it is sometimes desirable to extend the distance 100 that the panel overlaps the top flange 97 of the support beam 96. In this situation, a pair of the taller stiffer seal strip 115 are anchored on each edge of the beam.

In the precast deck panels of the present invention, threaded jack bolts are used to provide adjustability of each panel. The resilient grout seals that contain the grout or concrete which is forced between the bottom of the panel and the top of the supporting beam for bearing slides on the edge of the beam, or on the bottom surface of the panel, and is capable of maintaining its sealing action over a wide range of adjustment of the vertical space between the two. At any stage prior to pouring concrete on a panel, the jack bolt can be adjusted upwardly or downwardly and the grout seal will extend sufficiently that the seal between the beam and the panel will be maintained.

Figure 62:
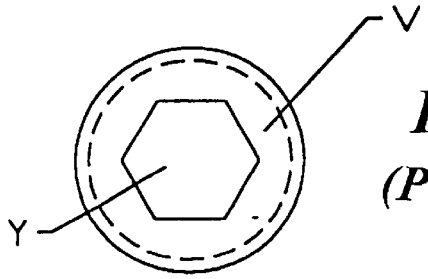
Fig. 62 (Prior Art)
FIG. 62 is a top section view of the threaded jack bolt of the prior art.
Figure 61:
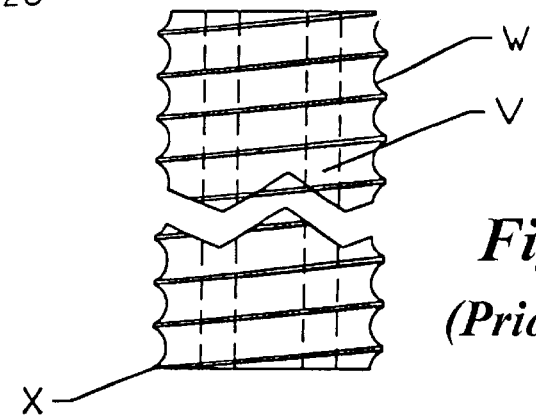
Fig. 61 (Prior Art)
FIG. 61 is a side elevation view of the threaded jack bolt of the prior art.

FIGS. 61 and 62 illustrate a conventional jack bolt V of the prior art as seen from the side and top, respectively. The jack bolt V has exterior threads W with a sharp edge X at the bottom end and a longitudinal hexagonal aperture Y extending therethrough. When the conventional jack bolts V are inserted through the embedded threaded inserts, they first encounter and deflect the seal strip. Due to the sharp square edge X on the bottom of the bolt, puncture and tearing of the seal strip can occur. When the conventional jack bolt is used in a maximum size panel, and is set to bear on a rough surface support beam, the bottom end of the bolt can be abraded away as the bolt is turned to raise the panel.

Figure 65:
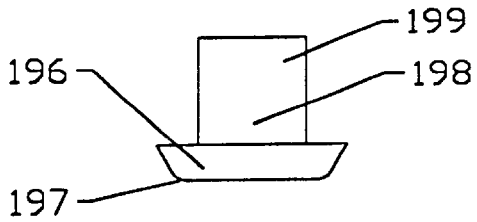
FIG. 65 is a side elevation view of another attachable foot for the threaded jack bolt of the prior art in accordance with one embodiment of the present invention.
Figure 66:
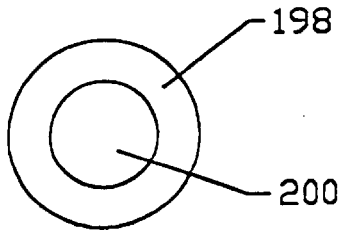
FIG. 66 is a top plan view of another attachable foot for the threaded jack bolt of the prior art in accordance with another embodiment of the present invention.

FIGS. 63–66 illustrate an attachable foot pad in accordance with the present invention for installation on a conventional jack bolt. In one embodiment, shown in FIGS. 61 and 62, the foot pad 194 has a vertical hexagonal extension 195 which is sized to be frictionally engaged in the hexagonal aperture Y of the bolt V, and a truncated cone base 196. The bottom edge of the truncated cone base 196 is filleted 197. In this embodiment the foot pad 194 rotates with the jack bolt. FIGS. 65 and 66 show another embodiment of the foot pad 198 which has a vertical cylindrical extension 199 sized to be frictionally engaged in the hexagonal aperture Y of the bolt and a truncated cone base 196 which is filleted 197. In the cylindrical extension embodiment 198, when the bolt bears on a rough surface, the foot pad does not rotate, but the bolt rotates on the foot pad.

The truncated cone base 196 of the foot pad 194 or 198 may have a larger diameter equal to the root diameter of the bolt thread W. The jack bolt foot pad 194 or 198 is quickly and easily installed by pushing the vertical extension 195 or 199 of the foot pad into the bottom of the hexagonal aperture in the bolt at any time prior to insertion of the bolt into the threaded insert in the panel. The modified jack bolts having the foot pads installed thereon prevent the sharp bottom edge of the bolt from cutting into and tearing the seal strip and prevents scouring and deformation of the surface of the structural support beam.

While this invention has been described fully and completely with special emphasis upon preferred embodiments, it should be understood that within the scope of the appended claims the invention may be practiced otherwise than as specifically described herein.

What is claimed is:

1. A precast concrete panel with a top and a bottom adapted to be assembled above a top surface of a support beam with one side edge thereof overlapping a side edge of the beam, whereby concrete or grout may be introduced through an end of a space between the bottom of the panel and the top surface of the beam which is adjacent the one side edge of the panel so as to support the panel from the beam; and a thin elongate seal strip formed of flexible material having a first anchoring portion along a first longitudinal edge anchored to said panel bottom adjacent to said panel side edge to extend substantially the length thereof, a contiguous mid portion extending from said anchoring portion, and a second anchoring portion along a second longitudinal edge adapted to engage and be anchored on either of said beam top surface and said beam side edge and form a sealing relation therewith;

said seal strip mid portion being sufficiently flexible so as to flex outwardly from said beam side edge when said panel side edge is set down upon said beam top surface, to maintain said sealing relation when said panel is thereafter vertically adjusted relative to said beam, and to resist horizontal pressure of the concrete or grout introduced into said space to prevent passage thereof past said seal strip mid portion.

2. A precast concrete panel with a top and a bottom adapted to be assembled above a top surface of a support beam with one side edge thereof overlapping a side edge of the beam, whereby concrete or grout may be introduced through an end of a space between the bottom of the panel and the top surface of the beam which is adjacent the one side edge of the panel so as to support the panel from the beam; and an elongate seal strip formed of resilient material anchored along a first longitudinal edge to said panel bottom adjacent its said one side edge to extend substantially the length thereof, a contiguous mid portion extending from said first longitudinal edge and terminating in a second longitudinal edge adapted to engage said beam top surface and form a sealing relation therewith;

said seal strip mid portion being sufficiently resilient so as to become compressed when said panel side edge is set down upon said beam top surface and maintain said sealing relation when said panel is thereafter vertically adjusted relative to said beam and resist horizontal pressure of the concrete or grout introduced into said space to prevent leakage thereof past said seal strip mid portion.

3. A precast concrete panel with a top and a bottom adapted to be assembled above a support beam with a side edge thereof overlapping a side edge of the beam, whereby concrete or grout may be introduced through an end of a space between the bottom of the panel and the top of the beam which is adjacent the side edge of the panel so as to support the panel from the beam; and a thin elongate seal strip formed of resilient material having an anchoring portion along a first longitudinal edge anchored to said panel bottom adjacent to and parallel to said panel side edge to extend substantially the length thereof and having a contiguous relatively wide flat portion extending from said anchoring portion to engage said beam side edge and form a sealing relation therewith;

said seal strip flat portion being sufficiently resilient so as to become deflected and slide downwardly on said beam side edge when said panel side edge is set down upon said beam, to maintain said sealing relation when said panel is thereafter vertically adjusted relative to said beam, and to resist horizontal pressure of the concrete or grout introduced into said space to prevent passage thereof past said engaged beam side edge.

4. The panel according to claim 3, further comprising:

vertically adjustable threaded bolt means mounted in said panel adjacent said panel side edge, said bolt means having a bottom end extensible and retractable relative to said panel bottom for contacting said beam top to adjustably space said panel above said beam;

said seal strip flat portion extends in a normally non-deflected disposition along said panel bottom beneath said bolt means bottom end in its retracted position and terminates in a second longitudinal edge disposed adjacent said panel side edge; and said bolt means being extendable to engage its said bottom end on said seal strip flat portion and deflect it downward from said panel bottom at an angle sufficient to position its said second longitudinal edge to clear said beam side edge such that said flat portion will angularly engage said beam side edge and slide downwardly thereon in resilient sealing relation as said panel side edge is set down upon said beam and is thereafter vertically adjusted relative thereto by said bolt means.

5. The panel according to claim 4, further comprising:

an elastomeric foot pad on said bolt means bottom end for preventing said bottom end from puncturing and tearing said seal strip flat portion and scouring and deforming said beam top.

6. The panel according to claim 3, further comprising;

an anchor channel on said panel bottom parallel to said panel side edge extending substantially the length thereof and having a hollow interior; and a protrusion along said first longitudinal edge of said seal strip received and secured in said anchor channel hollow interior;

said seal strip flat portion extending downward and outward from said protrusion in a direction toward said panel side edge at an angle such that its said second longitudinal edge will clear said beam side edge and said flat portion will angularly engage said beam side edge and slide downwardly thereon in sealing relation as said panel side edge is set down upon said beam and is thereafter vertically adjusted relative thereto.

7. The panel according to claim 6, further comprising a contiguous relatively short flat extension on said seal strip adjacent said protrusion extending horizontally therefrom in a direction away from said panel side edge and engaged on said panel bottom to provide a reaction bearing against said panel bottom; whereby during deflection of said sealing strip the bending moment in said seal strip is transferred to said panel by said protrusion acting in tension and said relatively short flat extension acting in compression.

8. The panel according to claim 6, wherein said seal strip when viewed in transverse cross section has a contiguous outwardly curved portion adjoining said protrusion with said relatively wide flat portion, said curved portion curving outward from said protrusion in a direction toward said panel side edge and then back inwardly to position said flat portion at an angle such that its said second longitudinal edge will clear said beam side edge and said flat portion will angularly engage said beam side edge and slide downwardly thereon in sealing relation as said panel side edge is set down upon said beam and is thereafter vertically adjusted relative thereto.

9. The panel according to claim 6, wherein said anchor channel comprises a tubular anchor channel embedded in said panel bottom during the casting of said panel and having a narrow longitudinally extending slot extending downward through its side wall; and said protrusion has a longitudinally extending circular portion received within said anchor channel hollow interior and a reduced neck portion extending through said slot and adjoined to said seal strip contiguous relatively wide flat portion.

10. The panel according to claim 6, wherein said anchor channel comprises a generally wedge-shaped anchor channel embedded in said panel bottom during the casting of said panel and in transverse cross section having a top wall and contiguous opposed side walls converging angularly downward and inward therefrom defining a narrow longitudinally extending opening at the bottom thereof; and said protrusion has a longitudinally extending generally wedge-shaped portion received within the interior of said generally wedge-shaped anchor channel and a reduced neck portion extending through said opening adjoined to said seal strip contiguous relatively wide flat portion.

11. The panel according to claim 6, wherein said anchor channel comprises a hollow tubular anchor channel cavity with a narrow longitudinally extending opening formed in said panel bottom during the casting of said panel; and said protrusion has a longitudinally extending circular portion received within said hollow tubular anchor channel cavity and a reduced neck portion extending through said narrow opening and adjoined to said seal strip contiguous relatively wide flat portion.

12. The panel according to claim 6, wherein said anchor channel comprises a generally wedge-shaped anchor channel cavity formed in said panel bottom during the casting of said panel and in transverse cross section having a top wall and contiguous opposed side walls converging angularly downward and inward therefrom defining a narrow longitudinally extending opening at the bottom thereof; and said protrusion has a longitudinally extending generally wedge-shaped portion received within the interior of said generally wedge-shaped anchor channel and a reduced neck portion extending through said opening adjoined to said seal strip contiguous relatively wide flat portion.

13. The panel according to claim 6, wherein said anchor channel comprises an inverted generally L-shaped anchor channel cavity formed in said panel bottom during the casting of said panel and in transverse cross section having a hollow horizontal top portion and a hollow vertical portion open at a bottom end to define a longitudinally extending opening in said panel bottom; and said protrusion is a longitudinally extending inverted generally L-shaped configuration having a horizontal top leg received in said hollow horizontal top portion and a vertical leg received in said hollow vertical portion and extending through said open bottom end adjoined to said seal strip contiguous relatively wide flat portion.

14. A method of rendering and maintaining a grout seal at one end of a space formed between a top surface of a support beam and an opposed bottom of a precast concrete panel whose side edge overlaps a side edge of the beam to prevent concrete or grout forced into the space from passing over the side edge of the beam, said method comprising the steps of:

providing a thin elongate seal strip formed of flexible material having a first anchoring portion along a first longitudinal edge, a second anchoring portion along a second longitudinal edge, and a contiguous mid portion extending therebetween;

anchoring said first anchoring portion on said panel bottom adjacent to and parallel to a respective said side edge thereof to extend substantially the length thereof; and anchoring said second anchoring portion on either of said beam top surface and said beam side edge to extend substantially the length thereof; whereby said seal strip mid portion forms a sealing barrier in the space between said beam top surface and said panel bottom to prevent concrete or grout forced into the space from passing over said beam side edge as said panel side edge is set down upon said beam and is thereafter vertically adjusted relative thereto.

15. The method according to claim 14, wherein said seal strip is formed of resilient flexible material and its said mid portion when viewed in transverse cross section having a contiguous outwardly curved portion adjoining said first anchoring portion and a relatively wide flat portion extending therefrom and terminating in said second longitudinal edge; and said step of anchoring said first anchoring portion on said panel bottom comprises anchoring said first anchoring portion on said panel with said curved portion curving outward in a direction toward said panel side edge and then back inwardly away from said panel side edge and with said flat portion positioned in a non-deflected disposition at an angle with respect to said panel bottom sufficient to position its said second longitudinal edge to clear said beam side edge such that said flat portion will angularly engage said beam side edge and slide downwardly thereon in resilient sealing relation as said panel side edge is set down upon said beam and is thereafter vertically adjusted relative thereto.

16. A method of rendering and maintaining a grout seal at one end of a space formed between a top surface of a support beam and an opposed bottom of a precast concrete panel whose side edge overlaps a side edge of the beam to prevent concrete or grout forced into the space from passing over the side edge of the beam, said method comprising the steps of:

providing an elongate seal strip formed of resilient material having a first longitudinal edge, a second longitudinal edge, and a contiguous mid portion extending therebetween;

anchoring said seal strip first longitudinal edge to said panel bottom adjacent its said side edge to extend substantially the length thereof with said mid portion and said second longitudinal edge extending downwardly therefrom; and setting said panel side edge down upon said beam top surface to engage said seal strip second longitudinal edge thereon and compress said mid portion to form a sealing barrier in the space between said beam top surface and said panel bottom to prevent concrete or grout forced into the space from passing over said beam side edge as said panel side edge is set down upon said beam and is thereafter vertically adjusted relative thereto.

17. A method of rendering and maintaining a resilient grout seal at one end of a space formed between a top surface of a support beam and an opposed bottom of a precast concrete panel whose side edge overlaps a side edge of the beam to prevent concrete or grout forced into the space from passing over the side edge of the beam, said method comprising the steps of:

providing vertically adjustable bolt means in said panel adjacent said panel side edge, said bolt means having a bottom end extensible and retractable relative to said panel bottom;

providing an elongate seal strip formed of resilient material having an anchoring portion along a first longitudinal edge and a contiguous relatively wide flat portion extending therefrom and terminating in a second longitudinal edge;

anchoring said anchoring portion of said seal strip on said panel bottom adjacent to and parallel to the respective said side edge thereof to extend substantially the length thereof with said flat portion extending in a normally non-detected disposition along said panel bottom beneath said bolt means bottom end in its retracted position and said second longitudinal edge disposed adjacent said panel side; and extending said bolt means to engage its said bottom end on said flat portion and deflect it downward from said panel bottom at an angle sufficient to position its said second longitudinal edge to clear said beam side edge such that said flat portion will angularly engage said beam side edge and slide downwardly thereon in resilient sealing relation as said panel side edge is set down upon said beam and is thereafter vertically adjusted relative thereto by said bolt means.

18. The method according to claim 17, including the step of installing an elastomeric foot pad on said bolt means bottom end to prevent said bottom end from puncturing and tearing said seal strip flat portion and scouring and deforming said beam top.

19. The method according to claim 17, wherein said seal strip anchoring portion when viewed in transverse cross section has a contiguous inverted generally V-shaped portion with a straight leg portion extending downward and angularly outward away from said panel side edge, a curved leg portion extending downwardly and outwardly toward said panel side edge, and said contiguous relatively wide flat portion extending from said curved leg portion in said normally horizontal non-deflected disposition; and said step of anchoring said anchoring portion comprises embedding said inverted generally V-shaped portion in said panel bottom to form an inverted generally V-shaped cavity inwardly adjacent said panel side edge during the casting of said panel with said flat portion extending horizontally outward along said panel bottom toward said panel side edge and said second longitudinal edge terminating near said panel side edge; and said bolt means is extended to engage its said bottom end on said flat portion and resiliently deflect said flat portion and said curved leg portion angularly downward from said panel bottom relative to said straight leg portion to expel any hardened grout or concrete from said V-shaped cavity that may have leaked into said cavity during the casting of said panel.

20. The method according to claim 17, wherein said seal strip anchor portion when viewed in transverse cross section has a contiguous inverted generally wedge-shaped portion with a contiguous flat horizontal top portion, a straight leg portion extending generally vertically downward from one end thereof, a sloped leg portion integrally hinged at an upper end with an opposite end of said top portion and extending angularly downward and inward therefrom toward said straight leg portion, and said contiguous relatively wide flat portion extending outwardly from the bottom of said sloped leg portion in said normally horizontal non-deflected disposition; and said step of anchoring said anchoring portion comprises embedding said inverted wedge-shaped anchor portion in said panel bottom to form an inverted wedge-shaped cavity inwardly adjacent said panel side edge during the casting of said panel with said flat portion extending horizontally outward along said panel bottom toward said panel side edge and said second longitudinal edge terminating near said side panel side edge; and said bolt means is extended to engage its said bottom end on said flat portion and pivot said flat portion and said sloped leg portion angularly downward and inward from said panel bottom about said sloped leg hinged upper end such that said sloped leg enters said inverted wedge-shaped cavity and said flat portion contacts a bottom end of said straight leg portion and thereafter said flat portion resiliently bends therearound with the remaining portion of said flat portion positioned at an angle sufficient to position said second longitudinal edge to clear said beam side edge such that said flat portion will angularly engage said beam side edge and slide downwardly thereon in sealing relation as said panel side edge is set down upon said beam and is thereafter vertically adjusted relative thereto.

21. The method according to claim 17, wherein said seal strip anchoring portion when viewed in transverse cross section has a contiguous inverted generally wedge-shaped anchor portion with a contiguous flat horizontal top portion, a first sloped leg portion extending angularly downward and inward from one end thereof, a second sloped leg portion integrally hinged at an upper end with an opposite end of said top portion and extending angularly downward and inward therefrom in opposed converging relation to said first sloped leg portion, and said contiguous relatively wide flat portion extending outwardly from the bottom of said second sloped leg portion in said normally horizontal non-deflected disposition; and said step of anchoring said anchoring portion comprises embedding said inverted wedge-shaped anchor portion in said panel bottom to form an inverted wedge-shaped cavity inwardly adjacent said panel side edge during the casting of said panel with said flat portion extending horizontally outward along said panel bottom toward said panel side edge and said second longitudinal edge terminating near said side panel side edge; and said bolt means is extended to engage its said bottom end on said flat portion and pivot said flat portion and said second sloped leg portion angularly downward and inward from said panel bottom about said second sloped leg hinged upper end such that said second sloped leg enters said inverted wedge-shaped cavity and said flat portion contacts a bottom end of said first sloped leg portion and thereafter said flat portion bends therearound with the remaining portion of said flat portion positioned at an angle sufficient to position said second longitudinal edge to clear said beam side edge such that said flat portion will angularly engage said beam side edge and slide downwardly thereon in sealing relation as said panel side edge is set down upon said beam and is thereafter vertically adjusted relative thereto.

22. The method according to claim 21, comprising the further step of:

prior to extending said bolt means to engage its said bottom end on said flat portion;

installing an elongate strip of resilient material in said inverted wedge-shaped anchor portion; and thereafter extending said bolt means to engage its said bottom end on said flat portion and deflect it downward from said panel bottom such that said elongate strip of resilient material is compressed by said second sloped leg portion as it enters said inverted wedge-shaped cavity to increase the force by which said flat portion is engaged with said beam side edge in sealing relation and compensate for stress relaxation and deformation of said flat portion.

23. The method according to claim 21, comprising the further step of:

prior to embedding said inverted wedge-shaped anchor portion in said panel bottom, installing an elongate strip of resilient material in said inverted wedge-shaped anchor portion to prevent intrusion of grout or concrete into said wedge-shaped cavity during the casting of said panel.

24. The method according to claim 17, wherein said seal strip anchoring portion when viewed in transverse cross section is a protrusion along said first longitudinal edge and said contiguous relatively wide flat portion extends angularly from said protrusion; and said step of anchoring said seal strip anchoring portion comprises:

providing a longitudinally extending anchor channel in said panel bottom parallel to said panel side edge extending substantially the length thereof, said anchor channel having an cavity sized and shaped to receive and firmly engage said protrusion and a downwardly facing opening smaller than said protrusion; and securing said seal strip protrusion in said anchor channel cavity such that said flat portion extends angularly downward and outward from said anchor channel in a direction toward said panel side edge; and said bolt means is extended to engage its said bottom end on said flat portion and deflect it downward from said panel bottom at an angle sufficient to position said second said second longitudinal edge to clear said beam side edge such that said flat portion will angularly engage said beam side edge and slide downwardly thereon in sealing relation as said panel side edge is set down upon said beam and is thereafter vertically adjusted relative thereto.

25. The method according to claim 24, wherein said seal strip anchoring portion when viewed in transverse cross section has a contiguous relatively short flat horizontal extension adjacent said protrusion; and said step of anchoring said seal strip anchoring portion comprises:

securing said seal strip protrusion in said anchor channel cavity such that said flat portion extends angularly downward and outward from said anchor channel in a direction toward said panel side edge and said contiguous relatively short flat extension is engaged on said panel bottom and extends horizontally in a direction away from said panel side edge to provide a reaction bearing against said panel bottom; and said bolt means is extended to engage its said bottom end on said flat portion and deflect it downward from said panel bottom at an angle sufficient to position said second said second longitudinal edge to clear said beam side edge and during deflection the bending moment in said seal strip is transferred to said panel by said protrusion acting in tension and said relatively short flat extension acting in compression.

26. The method according to claim 24, wherein said step of providing a longitudinally extending anchor channel in said panel bottom comprises embedding a longitudinally extending tubular anchor channel in said panel bottom parallel to said panel side edge to extend substantially the length thereof during the casting of said panel, said tubular anchor channel having an interior diameter sized to receive and firmly engage said protrusion and a longitudinally extending downwardly facing slot through its side wall smaller than said protrusion;

said protrusion is a longitudinally extending circular protrusion larger in diameter than said contiguous relatively wide flat portion; and said step of securing said seal strip protrusion in said anchor channel cavity comprises sliding said circular protrusion into said tubular anchor channel from an open end with said flat portion extending through said slot.

27. The method according to claim 24, wherein said step of providing a longitudinally extending anchor channel in said panel bottom comprises embedding a longitudinally extending generally wedge-shaped anchor channel in said panel bottom parallel to said panel side edge to extend substantially the length thereof during the casting of said panel, said generally wedge-shaped anchor channel in cross section having a top wall and contiguous opposed side walls converging angularly downward and inward therefrom defining a generally wedge-shaped cavity with a narrow longitudinally extending opening at the bottom thereof smaller in width than said generally wedge-shaped cavity; and said protrusion is a longitudinally extending generally wedge-shaped protrusion larger in width than said contiguous relatively wide flat portion; and said step of securing said seal strip protrusion in said anchor channel cavity comprises sliding said generally wedge-shaped protrusion into said generally wedge-shaped cavity from an open end with said flat portion extending through said opening.

28. The method according to claim 24, wherein said step of providing a longitudinally extending anchor channel in said panel bottom comprises forming a longitudinally extending hollow tubular anchor channel cavity with a longitudinally extending slot in said panel bottom parallel to said panel side edge to extend substantially the length thereof during the casting of said panel, said hollow tubular anchor channel cavity having an interior diameter sized to receive and firmly engage said protrusion and said longitudinally extending slot being smaller in width than said tubular anchor channel cavity;

said protrusion is a longitudinally extending circular protrusion larger in diameter than said contiguous relatively wide flat portion; and said step of securing said seal strip protrusion in said anchor channel cavity comprises sliding said circular protrusion into said tubular anchor channel cavity from an open end with said flat portion extending through said slot.

29. The method according to claim 24, wherein said step of providing a longitudinally extending anchor channel in said panel bottom comprises forming a longitudinally extending inverted generally L-shaped anchor channel cavity in said panel bottom parallel to said panel side edge to extend substantially the length thereof during the casting of said panel, said generally L-shaped anchor channel cavity having in cross section a hollow horizontal top portion and a hollow vertical portion open at a bottom end to define a longitudinally extending opening in said panel bottom sized to receive and firmly engage said protrusion;

said protrusion is a longitudinally extending inverted generally L-shaped protrusion having a horizontal top leg and a vertical leg contiguous with said relatively wide flat portion; and said step of securing said seal strip protrusion in said anchor channel cavity comprises sliding said generally L-shaped protrusion into said generally L-shaped anchor channel cavity from an open end with said flat portion extending through said hollow vertical portion.

* * * * *